US011403995B2

(12) United States Patent
Park

(10) Patent No.: US 11,403,995 B2
(45) Date of Patent: Aug. 2, 2022

(54) DISPLAY DEVICE AND METHOD OF DRIVING THE SAME

(71) Applicant: Samsung Display Co., Ltd., Yongin-Si (KR)

(72) Inventor: Jong Woong Park, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/229,755

(22) Filed: Apr. 13, 2021

(65) Prior Publication Data

US 2022/0139298 A1 May 5, 2022

(30) Foreign Application Priority Data

Oct. 30, 2020 (KR) ..... 10-2020-0143509

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2300/0452* (2013.01); *G09G 2310/027* (2013.01); *G09G 2320/0242* (2013.01); *G09G 2320/0285* (2013.01); *G09G 2320/0673* (2013.01); *G09G 2360/16* (2013.01)

(58) Field of Classification Search
CPC ..... G09G 3/32; G09G 3/2003; G09G 2300/0452; G09G 2310/027; G09G 2320/0673; G09G 2320/0285; G09G 2320/0242; G09G 2360/16
See application file for complete search history.

(56) References Cited

U.S. PATENT DOCUMENTS

| | | | | |
|---|---|---|---|---|
| 9,984,610 | B2 * | 5/2018 | Ahn | H04N 5/202 |
| 2020/0104562 | A1 * | 4/2020 | Sung | G06K 9/0004 |
| 2020/0219432 | A1 * | 7/2020 | Park | G09G 3/2007 |

FOREIGN PATENT DOCUMENTS

| | | | |
|---|---|---|---|
| KR | 10-2017-0044260 | A | 4/2017 |
| KR | 10-2020-0038388 | A | 4/2020 |
| KR | 10-2020-0085394 | A | 7/2020 |

* cited by examiner

*Primary Examiner* — Kenneth B Lee, Jr.
(74) *Attorney, Agent, or Firm* — Innovation Counsel LLP

(57) ABSTRACT

A display device includes pixels, a controller, and a data driver. The controller selects a target pixel among the pixels and generates an adjusted gray level for the target pixel based on gray levels corresponding to the target pixel and relevant pixels neighboring the target pixel. The data driver generates a data signal for the target pixel based on the adjusted gray level. The target pixel, at least one of the relevant pixels, and at least one of the pixels of the display device respectively emit light of three colors different from each other. Four mixed colors are different from each other and are each a mixture of at least two of the three colors. The controller generates the adjusted gray level using reference coefficients for at least one of the three colors and for at least one of the four mixed colors.

18 Claims, 20 Drawing Sheets

FIG. 7

| GRAY_IN | GRAY_RE |
|---|---|
| 32 | 32.000 |
| 31 | 31.000 |
| 30 | 30.000 |
| 29 | 29.000 |
| 28 | 28.000 |
| 27 | 27.500 |
| 26 | 27.000 |
| 25 | 26.000 |
| 24 | 25.000 |
| 23 | 24.500 |
| 22 | 24.000 |
| 21 | 23.000 |
| 20 | 22.500 |
| 19 | 22.000 |
| 18 | 21.500 |
| 17 | 21.000 |
| 16 | 20.000 |
| 15 | 19.500 |
| 14 | 19.000 |
| 13 | 18.500 |
| 12 | 18.000 |
| 11 | 17.500 |
| 10 | 17.000 |
| 9 | 16.750 |
| 8 | 16.250 |
| 7 | 16.000 |
| 6 | 15.750 |
| 5 | 15.250 |
| 4 | 15.000 |
| 3 | 14.750 |
| 2 | 14.500 |
| 1 | 14.250 |
| 0 | 14.000 |

FILTER (FT)

| | | | | |
|---|---|---|---|---|
| a1 | a2 | a0 | a3 | a4 |

FIG. 14

LUT2

| | R (X-coordinate) | | | | | G (Y-coordinate) | | | | | B (Z-coordinate) | | | | |
|---|---|---|---|---|---|---|---|---|---|---|---|---|---|---|---|
| | PX1 | PX2 | T_PX | PX3 | PX4 | PX1 | PX2 | T_PX | PX3 | PX4 | PX1 | PX2 | T_PX | PX3 | PX4 |
| RED (R_FACT) | RR1 | RR2 | RR0 | RR3 | RR4 | 0 | 0 | 0 | 0 | 0 | 0 | 0 | 0 | 0 | 0 |
| GREEN (G_FACT) | 0 | 0 | 0 | 0 | 0 | GG1 | GG2 | GG0 | GG3 | GG4 | 0 | 0 | 0 | 0 | 0 |
| BLUE (B_FACT) | 0 | 0 | 0 | 0 | 0 | 0 | 0 | 0 | 0 | 0 | BB1 | BB2 | BB0 | BB3 | BB4 |
| CYAN (C_FACT) | 0 | 0 | 0 | 0 | 0 | GC1 | GC2 | GC0 | GC3 | GC4 | BC1 | BC2 | BC0 | BC3 | BC4 |
| MAGENTA (M_FACT) | RM1 | RM2 | RM0 | RM3 | RM4 | 0 | 0 | 0 | 0 | 0 | BM1 | BM2 | BM0 | BM3 | BM4 |
| YELLOW (Y_FACT) | RY1 | RY2 | RY0 | RY3 | RY4 | GY1 | GY2 | GY0 | GY3 | GY4 | 0 | 0 | 0 | 0 | 0 |
| WHITE (W_FACT) | RW1 | RW2 | RW0 | RW3 | RW4 | GW1 | GW2 | GW0 | GW3 | GW4 | BW1 | BW2 | BW0 | BW3 | BW4 |

CONDITION1

CONDITION2

CONDITION3

CONDITION4

CONDITION5

CONDITION6

FIG. 19

LUT2'

| | R (X-coordinate) | | | | | G (Y-coordinate) | | | | | B (Z-coordinate) | | | | |
|---|---|---|---|---|---|---|---|---|---|---|---|---|---|---|---|
| | PX1 | PX2 | T_PX | PX3 | PX4 | PX1 | PX2 | T_PX | PX3 | PX4 | PX1 | PX2 | T_PX | PX3 | PX4 |
| RED (R_FACT) | RR1 | RR2 | RR0 | RR3 | RR4 | GR1 | GR2 | GR0 | GR3 | GR4 | BR1 | BR2 | BR0 | BR3 | BR4 |
| GREEN (G_FACT) | RG1 | RG2 | RG0 | RG3 | RG4 | GG1 | GG2 | GG0 | GG3 | GG4 | BG1 | BG2 | BG0 | BG3 | BG4 |
| BLUE (B_FACT) | RB1 | RB2 | RB0 | RB3 | RB4 | GB1 | GB2 | GB0 | GB3 | GB4 | BB1 | BB2 | BB0 | BB3 | BB4 |
| CYAN (C_FACT) | RC1 | RC2 | RC0 | RC3 | RC4 | GC1 | GC2 | GC0 | GC3 | GC4 | BC1 | BC2 | BC0 | BC3 | BC4 |
| MAGENTA (M_FACT) | RM1 | RM2 | RM0 | RM3 | RM4 | GM1 | GM2 | GM0 | GM3 | GM4 | BM1 | BM2 | BM0 | BM3 | BM4 |
| YELLOW (Y_FACT) | RY1 | RY2 | RY0 | RY3 | RY4 | GY1 | GY2 | GY0 | GY3 | GY4 | BY1 | BY2 | BY0 | BY3 | BY4 |
| WHITE (W_FACT) | RW1 | RW2 | RW0 | RW3 | RW4 | GW1 | GW2 | GW0 | GW3 | GW4 | BW1 | BW2 | BW0 | BW3 | BW4 |

FIG. 20

FILTER (FT2)

| | | |
|---|---|---|
| a1 | a0 | a2 |

FILTER (FT3)

| | | |
|---|---|---|
| a1 | a2 | a3 |
| a4 | a0 | a5 |
| a6 | a7 | a8 |

FILTER (FT4)

| | | | | |
|---|---|---|---|---|
| a1 | a2 | a3 | a4 | a5 |
| a6 | a7 | a0 | a8 | a9 |
| a10 | a11 | a12 | a13 | a14 |

DISPLAY DEVICE AND METHOD OF DRIVING THE SAME

CROSS-REFERENCE TO RELATED APPLICATION

This application claims priority to and the benefit of Korean Patent Application No. 10-2020-0143509 filed in the Korean Intellectual Property Office on Oct. 30, 2020; the Korean Patent Application is incorporated by reference.

BACKGROUND

(a) Field

The technical field relates to a display device.

(b) Description of the Related Art

A display device may receive signals and may display an image according to the signals.

A display device may include pixels that emit light of three different colors. A color of an area of the display device may be determined by a temporal sum or sum of the light emitted from the pixels of the area.

SUMMARY

An embodiment may be related to a display device that adjusts a gray level and/or a data signal to compensate for lateral leakage, in order to mitigate visibility degradation of a low grayscale and/or low luminance of mixed colors.

An embodiment may be related to a driving method of the display device.

An embodiment may be related to a display device that includes the following elements: pixels; a controller which receives image data including gray levels from the outside, and compensates for, based on a gray level corresponding to a target pixel among the pixels and gray levels corresponding to relevant pixels around the target pixel, the gray level of the target pixel; and a data driver which generates a data signal based on the compensated gray level, and supplies the data signal to the target pixel through a data line. At least one of the relevant pixels may emit light with a different color from the target pixel, and each of the pixels may emit light with one of a first color, a second color, and a third color based on the image data. The controller may compensate for the gray level based on a relationship between the gray level of the target pixel and the gray levels of the relevant pixels, reference coefficients set for the first to third colors, and reference coefficients set for first to fourth mixed colors that are representative colors obtained by mixing at least two of the first to third colors.

The controller may include a first data compensator that remaps the gray levels included in a first gray level range into first compensated gray levels included in a second gray level range; and a second data compensator that calculates compensation coefficients based on the reference coefficients, and applies weights calculated based on the compensation coefficients to the first compensated gray levels to generate a second compensated gray level of the target pixel.

The target pixel and the relevant pixels may be selected by a size of a predetermined compensation filter.

The controller may further include a memory storing a lookup table in which position information of pixels corresponding to the size of the compensation filter, and the reference coefficients of each of the first to third colors and the first to fourth mixed colors are set.

Information extracted from the lookup table may be a three-dimensional coordinate of the reference coefficients with the first color, the second color, and the third color as coordinate axes, respectively.

The lookup table may include a first table including the reference coefficients corresponding to coordinates of a first axis, a second table including the reference coefficients corresponding to coordinates of a second axis, and a third table including the reference coefficients corresponding to coordinates of a third axis.

The reference coefficients may be set according to the position of the pixels included in the compensation filter in each of the first to third tables.

The second data compensator may include: a color tendency determiner that determines a color tendency by comparing the gray levels for each color of the image data of pixels included in the compensation filter; a coefficient calculator that calculates a first coefficient, a second coefficient, and a third coefficient respectively corresponding to the first to third colors based on the color tendency and coordinate values determined by differences between the reference coefficients; a filter weight calculator that calculates weights of the pixels of the compensation filter by respectively applying the first to third coefficients to ratios of gray levels for each color to a maximum grayscale; and a gray level compensator that generates the second compensated gray level of the target pixel based on values obtained by applying the weights to the first compensated gray levels of the pixels of the compensation filter.

The first to third colors may be red, green, and blue, respectively.

The first to fourth mixed color may be yellow, magenta, cyan, and white, respectively.

The color tendency may be determined by one of six conditions according to a relationship between gray levels of the red, the green, and the blue.

The coefficient calculator may extract three-dimensional coordinate values of the reference coefficients corresponding to the color tendency from the lookup table, and the extracted coordinate values may be defined as a tetrahedron.

The first to third coefficients may be a length in a first axis direction, a length in a second axis direction, and a length in a third axis direction that are calculated from the tetrahedron.

When at least one of the relevant pixels emits light, the data signal that corresponds to a first gray level and is supplied to the target pixel may have a first voltage level, and when the relevant pixels do not emit light, the data signal that corresponds to the first gray level and is supplied to the target pixel may have a second voltage level different from the first voltage level.

When the image data corresponding to the target pixel and the relevant pixels is 30 gray level or less, the data signal supplied to the target pixel may be adjusted according to the gray levels corresponding to the relevant pixels.

An embodiment may be related to a method of driving a display device. The method may include the following steps: determining a color tendency by comparing gray levels for each color of image data corresponding to pixels to which a compensation filter is to be applied; calculating first to third coefficients respectively corresponding to first to third colors that are light emitting colors of the pixels based on predetermined reference coefficients and the determined color tendency; calculating weights of the pixels of the compensation filter by respectively applying the first to third coefficients to ratios of gray levels for each color with respect to a maximum grayscale; generating, based on values obtained by applying the weights to gray levels of the pixels of the compensation filter, a compensated gray level of a target pixel to which the compensation filter is applied; and converting the compensated gray level into an analog data signal to supply it to the target pixel. The reference coefficients may be set for the first to third colors, and for first to fourth mixed colors that are representative colors obtained by mixing at least two of the first to third colors.

The compensation filter may determine the target pixel and relevant pixels around the target pixel.

The calculating of the first to third coefficients may include: extracting three-dimensional coordinate values of the reference coefficients corresponding to the color tendency from a lookup table in which positions of the pixels corresponding to the compensation filter and the reference coefficients matched to each of the first to third colors are stored; and determining a length in a first axis direction, a length in a second axis direction, and a length in a third axis direction of a tetrahedron defined by the extracted three-dimensional coordinate values as the first to third coefficients, respectively.

An embodiment may be related to a display device. The display device may include pixels, a controller, a data line, and a data driver. The pixel may display an image. The pixels may display an image. The controller may receive image data, may select a target pixel among the pixels, and may generate an adjusted gray level for the target pixel based on a gray level corresponding to the target pixel and gray levels corresponding to relevant pixels neighboring the target pixel. The data driver may generate a data signal based on the adjusted gray level and may supply the data signal to the target pixel through the data line. The target pixel, at least one of the relevant pixels, and at least one of the pixels of the display device may respectively emit light of three colors different from each other. Four mixed colors may be different from each other and may be each a mixture of at least two of the three colors. The controller may generate the adjusted gray level using reference coefficients for at least one of the three colors and for at least one of the four mixed colors.

The controller may include the following elements: a first data adjuster, which may remap gray levels in a first gray level range into first adjusted gray levels in a second gray level range; and a second data adjuster, which may calculate adjustment coefficients based on the reference coefficients and may apply weights calculated based on the adjustment coefficients to the first adjusted gray levels to generate the adjusted gray level for the target pixel.

The controller may select the target pixel and the relevant pixels according to a structure and a size of a predetermined adjustment filter.

The controller may include a memory that stores a lookup table. The lookup table may include reference coefficients for seven colors for the target pixel and each of the relevant pixels. The seven colors may include the three colors and the four mixed colors.

An information set extracted from the lookup table may be a three-dimensional coordinate consisting of three of the reference coefficients for the seven colors with the three colors corresponding to three coordinate axes, respectively.

The lookup table may include a first table including a first subset of the reference coefficients for the seven colors corresponding to coordinates of a first axis, may include a second table including a second subset of the reference coefficients for the seven colors corresponding to coordinates of a second axis, and may include a third table including a third subset of the reference coefficients for the seven colors corresponding to coordinates of a third axis.

Reference coefficients in each of the first subset of the reference coefficients for the seven colors, the second subset of the reference coefficients for the seven colors, the third subset of the reference coefficients for the seven colors may depend on pixel positions specified in the predetermined adjustment filter.

The second data adjuster may include the following elements: a color tendency determiner, which may determine a color tendency by comparing gray levels for the three colors according to image data for the target pixel and the relevant pixels; a coefficient calculator, which may calculate a first coefficient, a second coefficient, and a third coefficient respectively corresponding to the three colors based on the color tendency and coordinate values determined by differences between some of the reference coefficients for the seven colors; a filter weight calculator, which may calculate weights for the relevant pixels using the first coefficient, gray level values for the three colors, and a maximum gray level value for the display device; and a gray level adjuster, which may generate the adjusted gray level for the target pixel by applying the weights to first adjusted gray levels of the target pixel and the relevant pixels.

The three colors may include red, green, and blue.

The four mixed colors may include yellow, magenta, cyan, and white.

The color tendency determiner may determine the color tendency based on one of six conditions according to a relationship between a gray level of the red, a gray level of the green, and a gray level of the blue.

The coefficient calculator may extract three-dimensional coordinate values of reference coefficients corresponding to the color tendency from the lookup table. The three-dimensional coordinate values may define a tetrahedron in a color space.

The first coefficient, the second coefficient, and the third coefficient may be a length in a first axis direction, a length in a second axis direction, and a length in a third axis direction corresponding to three edges of the tetrahedron.

When at least one of the relevant pixels emits light, the data signal supplied to the target pixel may have a first voltage level. When the relevant pixels do not emit light, the data signal supplied to the target pixel may have a second voltage level different from the first voltage level.

When the gray level corresponding to the target pixel and the gray levels corresponding to the relevant pixels are 30 or less according to the image data, the data signal supplied to the target pixel may be adjusted according to the gray levels corresponding to the relevant pixels.

An embodiment may be related to method of driving a display device. The method may include the following steps: selecting a target pixel and relevant pixels according to an adjustment filter; determining a color tendency by comparing gray levels according to image data for colors corresponding to the target pixel and the relevant pixels; calculating a first coefficient, a second coefficient, and a third coefficient respectively corresponding to three colors of pixels of the display device based on reference coefficients and the color tendency; calculating weights for the relevant pixels using the first coefficient, the second coefficient, the third coefficient, a gray level values for the three colors, and a maximum gray level value for the display device; generating a adjusted gray level for the target pixel by applying the weights to the relevant pixels; converting the adjusted gray level into an analog data signal; and supplying the analog data signal through a data line to the target pixel for the target pixel to emit light. The reference coefficients may be for at least one of the three colors and for at least one of four mixed colors. The four mixed colors may be different from each other and may be each a mixture of at least two of the three colors.

At least one of the relevant pixels may immediately neighbor the target pixel with no intervening pixel.

The calculating of the first coefficient, the second coefficient, and the third coefficient may include the following steps: extracting three-dimensional coordinate values reference coefficients corresponding to the color tendency from a lookup table, which includes reference coefficients for the three colors and the four mixed colors for the target pixel and each of the relevant pixels; and determining a length in a first axis direction, a length in a second axis direction, and a length in a third axis direction along three edges of a tetrahedron defined by the extracted three-dimensional coordinate values as the first coefficient, the second coefficient, and the third coefficient, respectively.

BRIEF DESCRIPTION OF THE DRAWINGS

FIG. 7 illustrates a lookup table used in a first data compensator included in the controller of FIG. 5 according to embodiments.

FIG. 14 illustrates a lookup table used in the second data compensator of FIG. 13 according to embodiments.

FIG. 19 illustrates a lookup table used in the second data compensator of FIG. 5 according to embodiments.

FIG. 20 illustrates compensation filters applicable to the second data compensator of FIG. 5 according to embodiments.

DETAILED DESCRIPTION OF EMBODIMENTS

Figure 1:
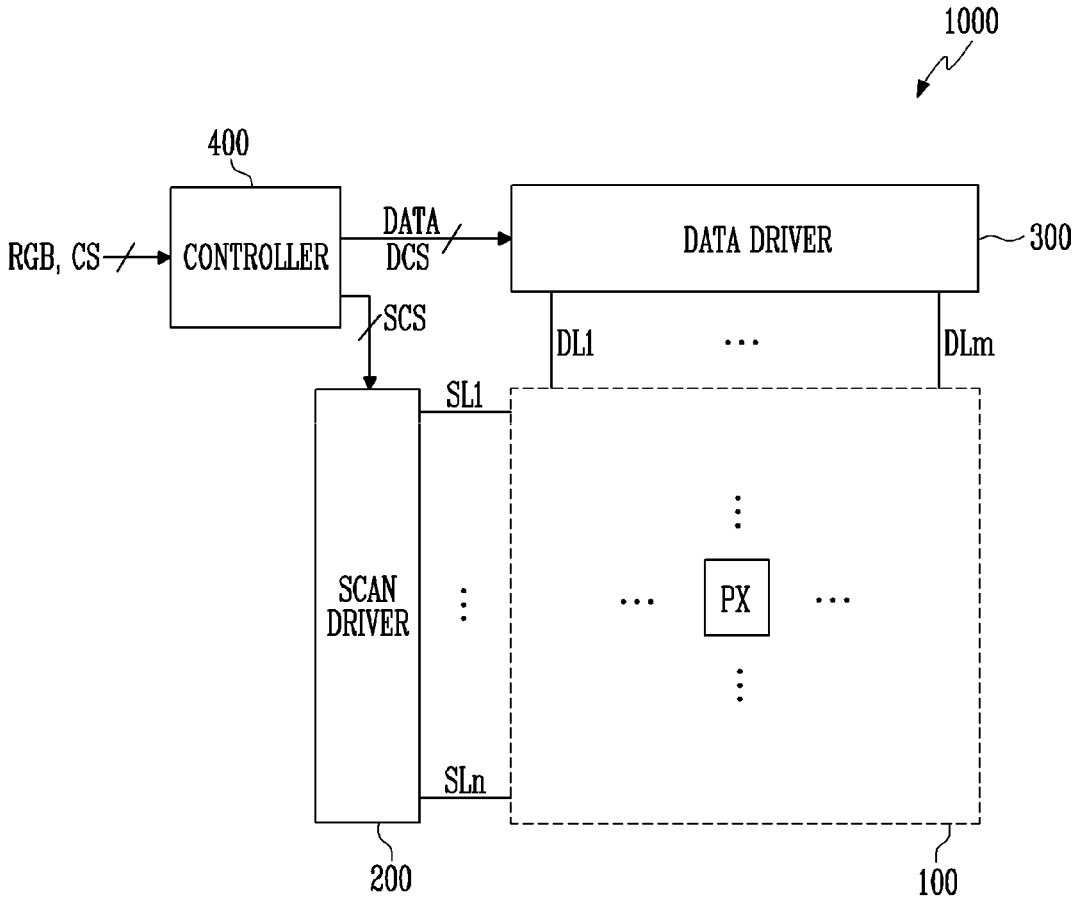
FIG. 1 illustrates a block diagram of a display device according to embodiments.

Example embodiments are described with reference to the accompanying drawings. The same reference numerals are used for the same elements or analogous elements.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-category (or first-set)," "second-category (or second-set)," etc., respectively.

A first color may be red, green, or blue. A second color may be different from the "first color" and may be green, blue, or red. A "third color" may be different from each of the "first color" and the "second color" and may be blue, red, or green.

A first mixed color, a second mixed color, a third mixed color, and a fourth mixed color may be different from each other and each may be yellow, magenta, cyan, or white.

The term "connected" may mean "electrically connected" or "electrically connected through no intervening transistor." The term "insulate" may mean "electrically insulate" or "electrically isolate." The term "conductive" may mean "electrically conductive." The term "drive" may mean "operate" or "control." The term "compensate" may mean "adjust." The term "correct" may mean "adjust." The term "compensator" may mean "adjuster." The term "pattern" may mean "member." The term "remap" may mean "map."

FIG. 1 illustrates a block diagram of a display device according to embodiments.

Referring to FIG. 1, a display device 1000 may include a display area 100 (or display panel 100), a scan driver 200, a data driver 300, and a controller 400.

The display device 1000 may be a flat panel display, a flexible display device, a curved display device, a foldable display device, a bendable display device, or a stretchable display device. The display device may be applied to one or more of a transparent display device, a head-mounted display device, a wearable display device, and the like. The display device 1000 may be applied to one or more of various electronic devices, such as a smart phone, a tablet, a smart pad, a TV, and a monitor.

The display device 1000 may include a plurality of light emitting elements. For example, the display device 1000 may include organic light emitting elements, inorganic light emitting elements, or light emitting elements made of a combination of inorganic and organic materials. The display device 1000 may be a liquid crystal display device, a plasma display device, a quantum dot display device, or the like.

The display area 100 may display an image. The display area 100 may be a display panel.

The display area 100 may include data lines DL1 to DLm (wherein m is a positive integer), scan lines SL1 to SLn (wherein n is a positive integer), and pixels PX. The pixels PX may be electrically connected to the data lines DL1 to DLm and the scan lines SL1 to SLn.

The scan driver 200 may receive a scan control signal SCS from the controller 400. The scan driver 200 receiving the scan control signal SCS and may supply scan signals to the scan lines SL1 to SLn. The scan control signal SCS may include an initiation signal, clock signals, and the like.

The scan driver 200 may be formed on the display area 100, or may be an IC mounted on a flexible circuit board that is connected to the display area 100.

The data driver 300 may generate data signals based on a data control signal DCS and image data DATA and may provide the data signals to the data lines DL1 to DLm. The data control signal DCS may control an operation of the data driver 300 and may include a data enable signal.

The data driver 300 may be an IC (for example, driving IC) and may be mounted on a flexible circuit board that is connected to the display area 100.

The controller 400 may receive input image data RGB (for example, RGB data) and a control signal CS from an external source (for example, a graphic processor), and may generate the scan control signal SCS and the data control signal DCS based on the control signal CS. The input image data RGB may include gray level data corresponding to the pixels PX.

The control signal CS may include a clock signal, a horizontal synchronization signal, and a data enable signal. The controller 400 may rearrange the input image data RGB into image data DATA matching the pixel arrangement of the display area 100 and may output the image data DATA.

The controller 400 may remap a gray level included in the input image data RGB within a second grayscale range from a first gray level range to generate a remapped gray level (or a first compensated/adjusted gray level). The second gray level range may be included in the first gray level range. The controller 400 may remap a gray level from the first gray level range between 0 to 255 gray levels to the second gray level range between 14 to 255 gray levels.

The controller 400 may adjust a gray level of a target pixel based on a gray level corresponding to the target pixel among the pixels PX and gray levels corresponding to relevant pixels around the target pixel. The controller 400 may generate a compensated/adjusted gray level (or a second compensated/adjusted gray level value) by adjusting the gray level of the target pixel based on the remapped gray levels of the target pixel and the relevant pixels. The relevant pixels may be pixels that affect gray level compensation/adjustment of the target pixel, and may be pixels included in a compensation filter (or adjustment filter) for gray level compensation/adjustment of the target pixel.

The controller 400 may adjust a gray level based on a relationship between the gray level of the target pixel and the gray levels of the relevant pixels and predetermined reference coefficients.

The gray level of the target pixel and the gray levels of the relevant pixel are compared with each other to determine a relationship, and a weight may be determined using the determined result and the reference coefficients.

Each of the pixels PX may emit light of a first color, a second color, or a third color. The first color, the second color, and the third color may be red, green, and blue, respectively. The reference coefficients may be set for the first color, the second color, and the third color. The input image data RGB may include information on the first color, the second color, and the third color.

The pixels adjacent to each other may emit light of different colors. For example, at least one of the relevant pixels may emit light of a different color from that of the target pixel. A mixed color may be viewed due to the additive mixing of the light emitting colors of the adjacent pixels. For example, by mixing at least two colors among red, green, and blue, a first mixed color, a second mixed color, a third mixed color, and a fourth mixed color may be defined. The first mixed color, the second mixed color, the third mixed color, and the fourth mixed color may be yellow, magenta, cyan, and white, respectively. Reference coefficients may be further set for the first to fourth mixed colors.

The controller 400 may apply a weight according to the relationship to the reference coefficients set for the first to third colors and the first to fourth mixed colors for calculating the second compensated gray level of the target pixel.

The controller 400 may decrease the gray level of the target pixel as at least one of the gray levels of the relevant pixels increases.

The controller 400 may be separate from the data driver 300. At least some of the functions of the controller 400 may be implemented in one IC together with the data driver 300, or may be implemented in the data driver 300.

Figure 2:
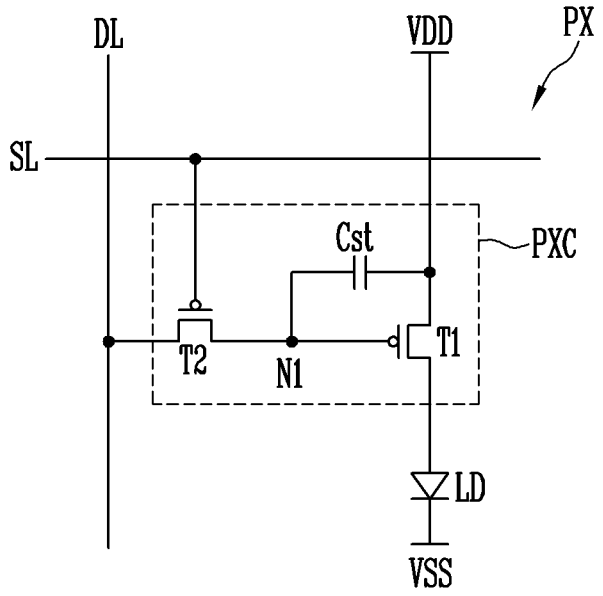
FIG. 2 illustrates a circuit diagram of a pixel included in the display device of FIG. 1 according to embodiments.
Figure 3:
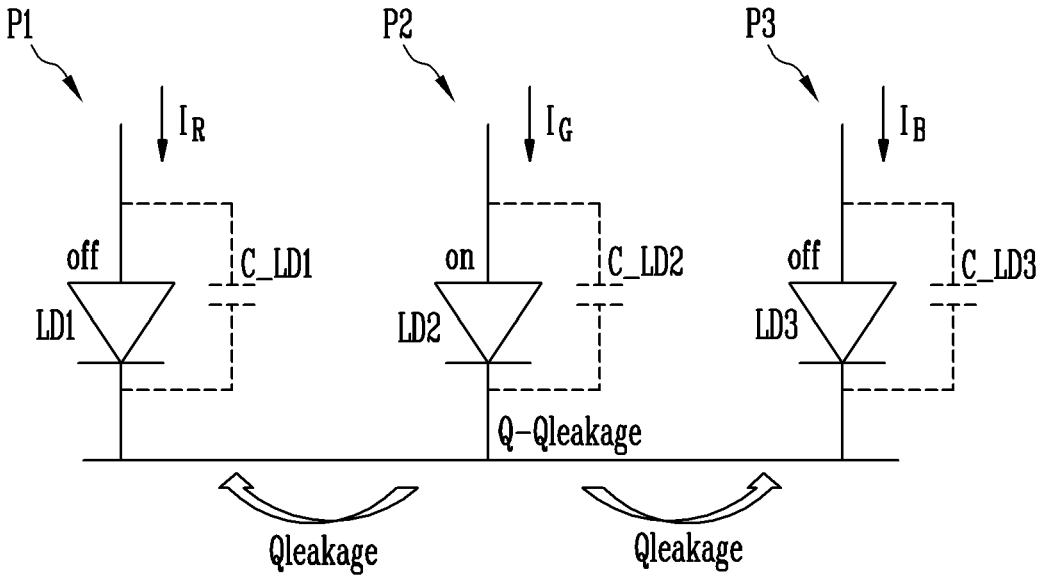
FIG. 3 is a drawing for explaining a relationship between pixels included in the display device of FIG. 1 according to embodiments.

FIG. 2 illustrates a circuit diagram of a pixel included in the display device of FIG. 1 according to embodiments. FIG. 3 is a drawing for explaining a relationship between pixels included in the display device of FIG. 1 according to embodiments.

Referring to FIG. 1, FIG. 2, and FIG. 3, the pixel PX may include a first transistor T1, a second transistor T2, a storage capacitor Cst, and a light emitting element LD.

The first transistor T1 and the second transistor T2 may be P-type transistors (for example, PMOS transistors). At least one of the first transistor T1 and the second transistor T2 may be an N-type transistor (for example, NMOS transistor). The pixel PX may include other transistors in addition to the first transistor T1 and the second transistor T2.

The first transistor T1 (or driving transistor) may include a first electrode connected to a first power line to which a voltage of a first power source VDD is applied, a second electrode connected to an anode electrode of the light-emitting element LD, and a gate electrode connected to a first node N1.

The second transistor T2 (or switching transistor) may include a first electrode connected to a data line DL, a second electrode connected to the first node N1, and a gate electrode connected to a scan line SL. The data line DL may be one of the data lines DL1 to DLm illustrated in FIG. 1, and the scan line GL may be one of the scan lines SL1 to SLn illustrated in FIG. 1.

The second transistor T2 may be turned on in response to a scan signal provided through the scan line SL to transmit a data signal provided through the data line DL to the first node N1. The scan signal may be a pulse signal having a turn-on voltage level that turns on the second transistor T2.

The storage capacitor Cst may be connected between the first node N1 and a first power line (to which a voltage of the first power source VDD is applied). The storage capacitor Cst may temporarily store a data signal applied to the first node N1. The first transistor T1 may adjust an amount of driving current flowing from the first power line to the light emitting element LD in response to the data signal stored in the storage capacitor Cst.

The light emitting element LD (or light emitting diode) may include the anode electrode connected to the first transistor T1 and may include a cathode electrode connected to a second power line (to which a voltage of a second power source VSS is applied). The light emitting element LD may be an organic light emitting element, an inorganic light emitting element, or a light emitting element including an organic material and an inorganic material. The light emitting element LD may emit light with luminance corresponding to a driving current (or a current amount of driving current).

Referring to FIG. 3, a first pixel P1 may include a first light emitting element LD1 that emits light of a first color, a second pixel P2 may include a second light emitting element LD2 that emits light of a second color, and a third pixel P3 may include a third light emitting element LD3 that emits light of a third color. For example, the first light emitting element LD1 may emit red light, the second light emitting element LD2 may emit green light, and the third light emitting element LD3 may emit blue light. The pixels P1, P2, and P3 may respectively include parasitic capacitors C_LD1, C_LD2, and C_LD3.

When no driving currents are supposed to flow through the first pixel P1 and third pixel P3 adjacent to the second pixel P2 (that is, IR=0, IB=0), some of a second driving current (IG) flowing through the second pixel P2 may leak to the first pixel P1 and the third pixel P3 through a common layer of the light emitting elements LD1, LD2, and LD3 (for example, conductive patterns/members connected to each other). This leakage is defined as lateral leakage. A leakage charge (Q-leakage) moving from the second pixel P2 to the pixels P1 and P3 may occur, and the second pixel P2 emits light with luminance that is lower than desired luminance, due to reduced charge (Q-Qleakage).

When the second driving current IG is significantly larger than the leakage current, a ratio at which luminance is reduced is small, and thus the reduced luminance may be inconspicuous to a user of the display device. When the second driving current IG is relatively small, a ratio of the reduced luminance is relatively large, and thus the reduced luminance may be conspicuous to the user. That is, in a low current area in which the driving current is relatively small (or in a low luminance area and/or a low gray level area), a changed or undesirable light emitting characteristic of a pixel may be conspicuous.

Figure 4:
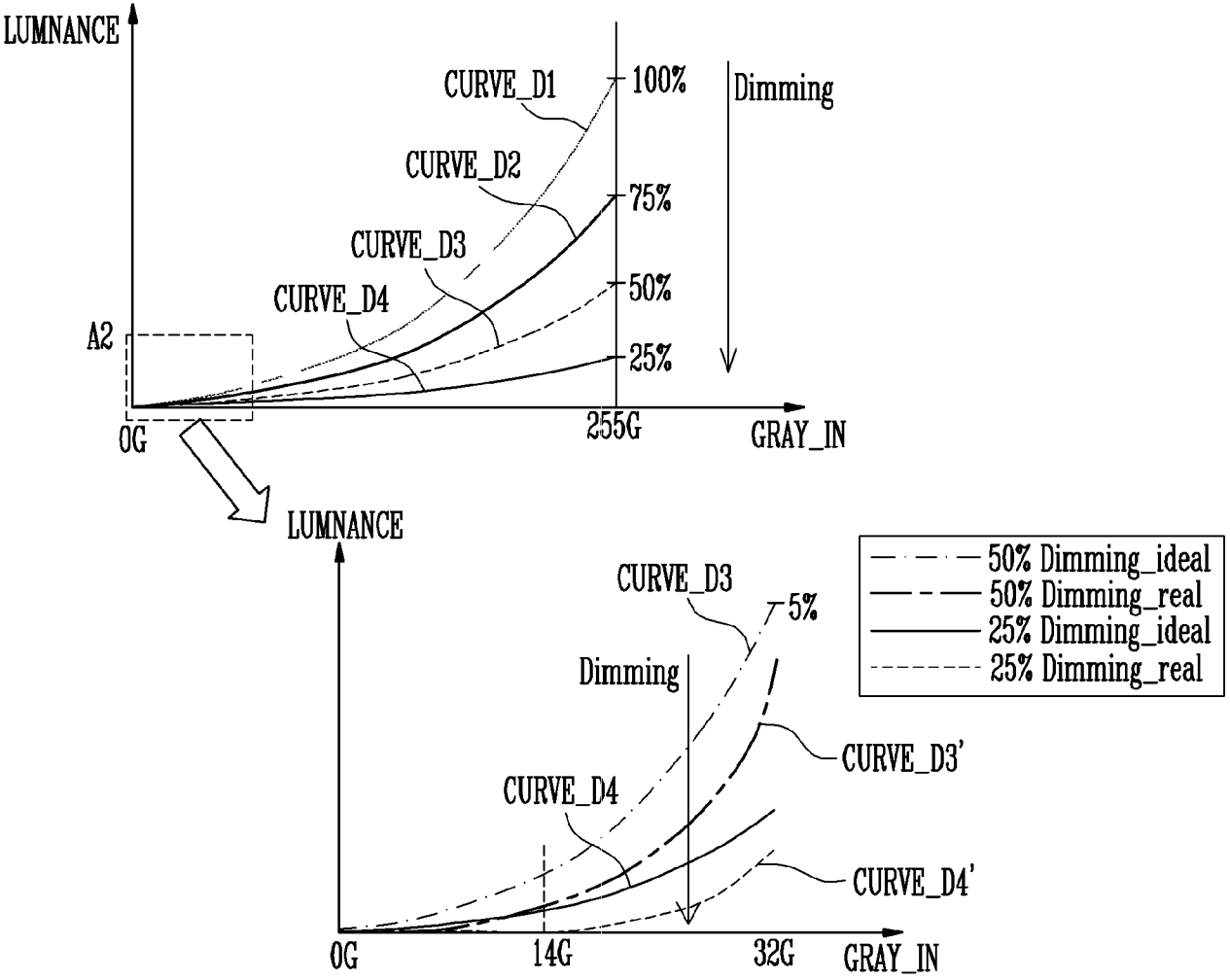
FIG. 4 illustrates luminance according to a gray level of pixels included in the display device of FIG. 1 according to embodiments.

FIG. 4 illustrates luminance according to a gray level of pixels included in the display device of FIG. 1 according to embodiments.

Referring to FIG. 4, curves (CURVE_D1, CURVE_D2, CURVE_D3, and CURVE_D4 represent luminance according to an input gray level GRAY_IN (a gray level included in the input image data RGB illustrated in FIG. 1). The curves CURVE_D1 to CURVE_D4 may correspond to gamma curves for dimming levels of a display device 1. The fourth curve CURVE_D4 may correspond to a dimming level lower than that of the first curve CURVE_D1. The dimming level is a ratio of a maximum display luminance to a maximum luminance of the display device 1000, and the higher the dimming level is, the higher the maximum display luminance may be.

In a second area A2 (a low gray level area with a gray level within a range of 0 to 32) shown in FIG. 4, a third actual curve CURVE_D3' having a 50% dimming level displays lower luminance than the third curve CURVE_D3 (an ideal gamma curve). Similarly, a fourth actual curve CURVE_D4' with a 25% dimming level displays lower luminance than the fourth curve CURVE_D4, and for example, gray levels of 14 or less on the fourth actual curve CURVE_D4' may substantially correspond to zero luminance.

The controller 400 may remap the input gray level GRAY_IN in a gray level range (for example, a gray level range of a gray level of 14 or less shown in FIG. 4) in which luminance of the input image data RGB is not displayed to a gray level in a gray level range (for example, a gray level range larger than a gray level of 14) in which luminance is displayed.

Figure 5:
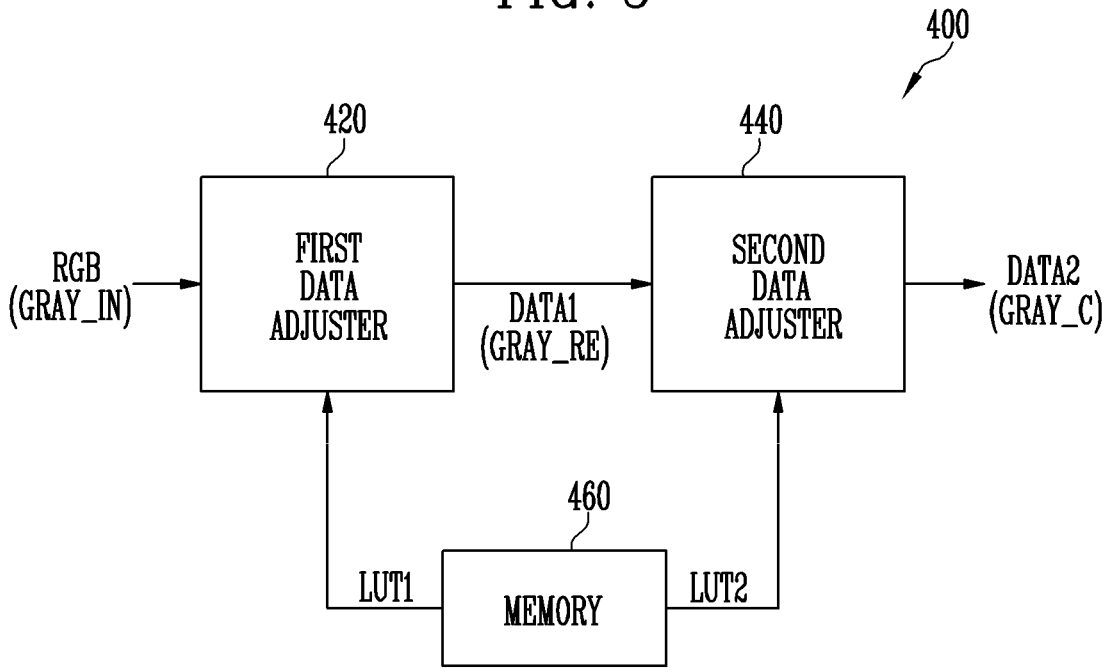
FIG. 5 illustrates a block diagram of a controller included in the display device of FIG. 1 according to embodiments.

FIG. 5 illustrates a block diagram of a controller included in the display device of FIG. 1 according to embodiments.

Referring to FIG. 1 and FIG. 5, the controller 400 may include a first data compensator/adjuster 420, a second data compensator/adjuster 440, and a memory 460.

The first data compensator 420 may remap the input gray level GRAY_IN included in the input image data RGB within the second gray level range from the first gray level range to generate the remapped gray level GRAY_RE. The remapped gray level GRAY_RE may be included in first data DATA1.

The first data compensator 420 may convert the input image data RGB into a data format corresponding to arrangement of the pixels PX before remapping the input gray level GRAY_IN.

The first data compensator 420 may remap the input gray level GRAY_IN to the remapped gray level GRAY_RE using a first lookup table LUT1 stored in the memory 460.

The second data compensator 440 may calculate compensation/adjustment coefficients based on reference coefficients. The second data compensator 440 may generate a compensated/adjusted gray level GRAY_C (or a second compensated gray level value) of the target pixel by applying weights (calculated based on the compensation coefficients) to the remapped gray levels GARY_RE (or first compensated gray levels). The compensated gray level GRAY_C may be included in second data DATA2.

The second data compensator 440 may extract the reference coefficients used for calculating the compensation coefficients using a second lookup table LUT2 stored in the memory 460.

The memory 460 may store the first lookup table LUT1 and the second lookup table LUT2. The memory 460 may be a non-volatile memory.

Figure 6:
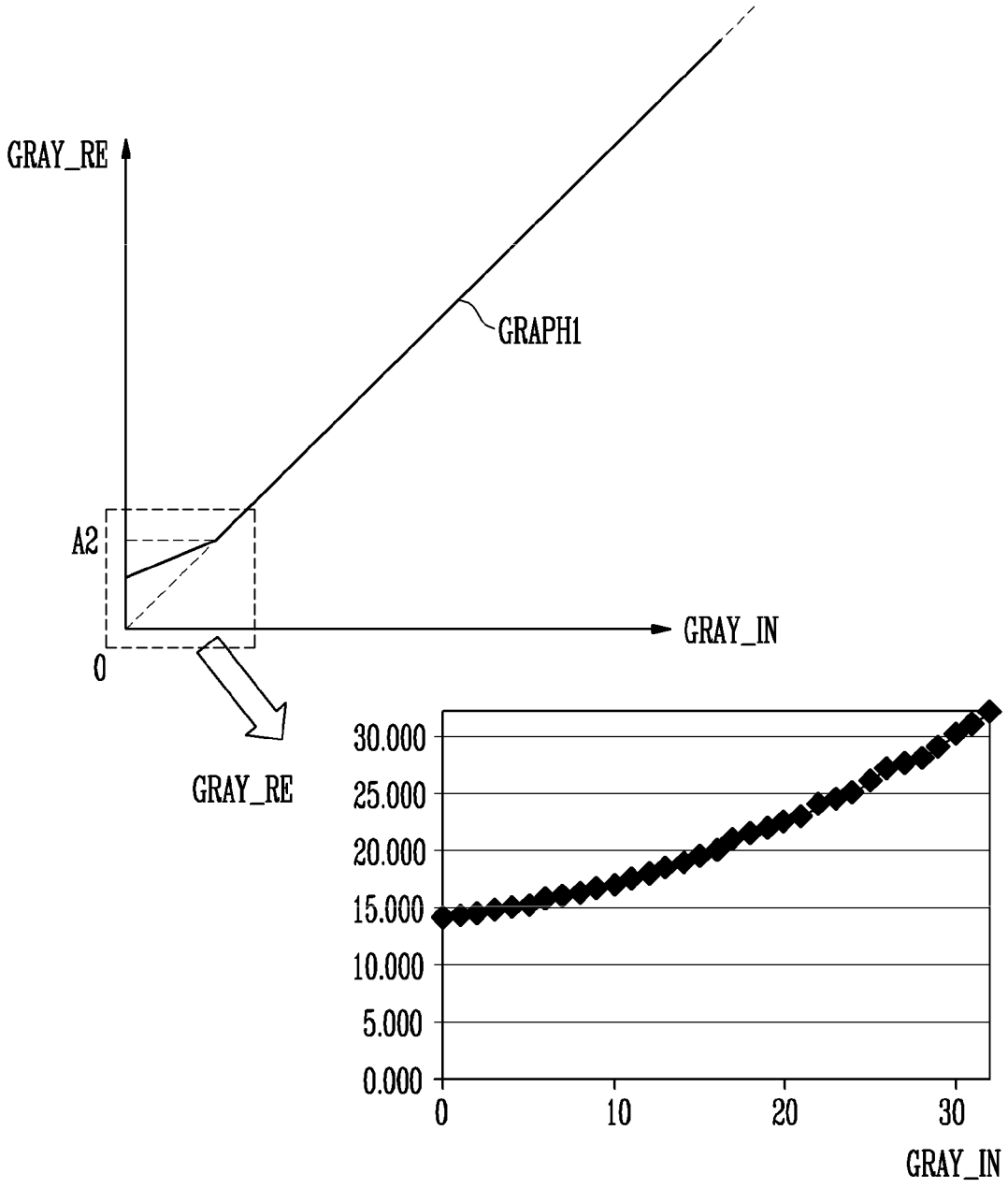
FIG. 6 is a drawing for explaining an operation of a first data compensator included in the controller of FIG. 5 according to embodiments.

FIG. 6 is a drawing for explaining an operation of the first data compensator 420 included in the controller 400 illustrated in FIG. 5 according to embodiments. FIG. 7 illustrates a lookup table LUT1 used by the first data compensator 420 according to embodiments.

Referring to FIG. 4, FIG. 5, FIG. 6, and FIG. 7, a first graph GRAPH1 shows a relationship of the input gray level GRAY_IN included in the input image data RGB and the remapped gray level GRAY_RE (or first compensated gray level).

The first data compensator 420 may remap the gray levels included in the first gray level range to the remapped gray levels GRAY_RE included in the second gray level range.

The first gray level range may include a first low gray level area, and the second gray level range may include a second low gray level area. The second low gray level area may be included in (or within the limits of) a gray level range of the first low gray level area.

The first data compensator 420 may remap first low gray levels included in the first low gray level area to second low gray levels included in the second low gray level area.

The first data compensator 420 may remap the input gray level GRAY_IN (e.g., 0, 1, and 2) included in the first low gray level area with a gray level of 0 to 32 to the remapped gray level GRAY_RE (e.g., 14, 14.25, and 14.5) included in the second low gray level area with a gray level of 14 to 32.

The first data compensator 420 may find a first gray level (for example, a gray level of 14) at which luminance starts to be displayed (for example, starts to emit light) in the fourth actual curve CURVE_D4' described with reference to FIG. 4, and may set the first gray level to a start gray level (for example, the minimum gray level in the second low gray level area). The first data compensator 420 may find a second gray level (for example, a gray level of 32) where the fourth actual curve CURVE_D4' and the fourth curve CURVE_D4 meet to set the second gray level to an end gray level (for example, the maximum gray level in the second low gray level area). The first data compensator 420 may remap the input gray level GRAY_IN included in the first low gray level area (with a gray level of 0 to 32) to the remapped gray level GRAY_RE included in the second low gray level area (with a gray level of 14 to 32).

The first data compensator 420 may remap the input gray level GRAY_IN in the first gray level range to the remapped gray level GRAY_RE in the second gray level range according to Equation 1 below.

$$GRAY_RE=(GRAY_END-GRAY_START)/GRAY_END*GARY_IN+GRAY_START \quad \text{[Equation 1]}$$

GRAY_END may be the end gray level, and GRAY_START may be the start gray level.

The first data compensator 420 may remap the input gray level GRAY_IN to the remapped gray level GRAY_RE using the first lookup table LUT1. The first lookup table LUT1 may include mapping information between the input gray level GRAY_IN and the remapped gray level GRAY_RE, and may be stored in the memory 460.

As shown in FIG. 7, the first lookup table LUT1 may include the remapped gray levels GRAY_RE in the range of 14 to 32 corresponding to the input gray levels GRAY_IN of 0 to 32.

The input gray level GRAY_IN of 0 corresponds to the remapped gray level GRAY_RE of 14, and as the input gray level GRAY_IN increases by a gray level of 1, the remapped gray level GRAY_RE may increase by a gray level of 0.25 or 0.5, less than 1.

Accordingly, the low gray levels of the input image data RGB may be remapped to larger values for higher luminance.

The remapped gray level GRAY_RE corresponding to each of the target pixel and relevant pixels may be provided to the second data compensator 440 as the first data DATA1. The second data compensator 440 may generate the second data DATA2 including a finally compensated/adjusted gray level GRAY_C using the remapped gray levels GRAY_RE included in the first data DATA1.

Figure 8:
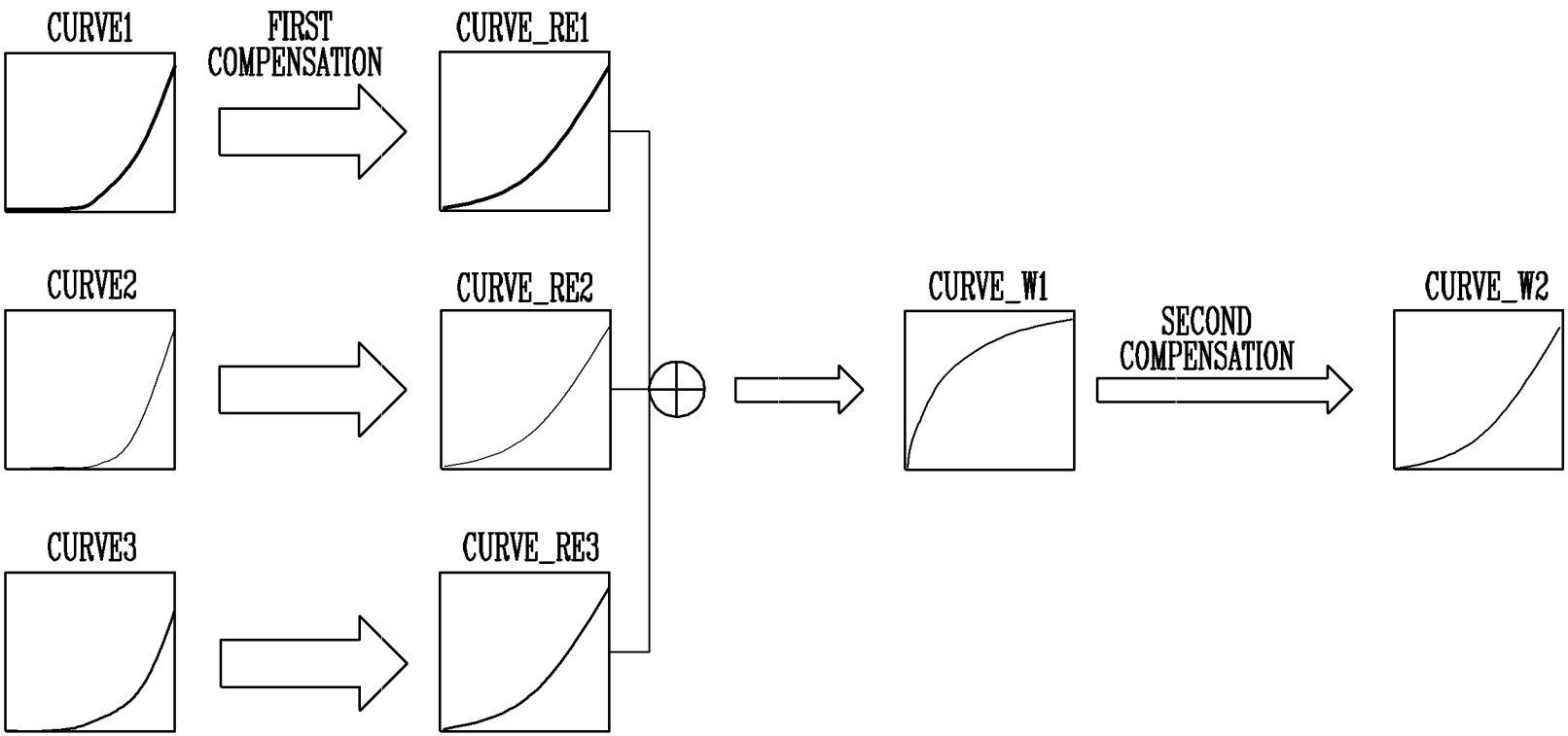
FIG. 8 illustrates a change in a gamma curve by the controller of FIG. 5 according to embodiments.

FIG. 8 illustrates a change in a gamma curve by the controller of FIG. 5.

Referring to FIG. 3, FIG. 5, and FIG. 8, gray level remapping for image data corresponding to each of pixels PX1, PX2, and PX3 is performed, and a light emitting characteristic (or gamma characteristic) of each of the pixels PX1 to PX3 may be adjusted to be identical or similar to the reference gamma characteristic (for example, represented by a 2.2 gamma curve).

As shown in FIG. 8, a first gamma curve CURVE1 representing the light emitting characteristic of the first pixel PX1 that emits the first color may be converted into a first compensated gamma curve CURVE_RE1 having the same or similar shape as the reference gamma curve through gray level remapping. A second gamma curve CURVE2 representing the light emitting characteristic of the second pixel PX2 that emits the second color may be converted into a second compensated gamma curve CURVE_RE2 having the same or similar shape as the reference gamma curve. A third gamma curve CURVE3 representing the light emitting characteristic of the third pixel PX3 that emits the third color may be converted into a third compensated gamma curve CURVE_RE3 having the same or similar shape as the reference gamma curve.

When the compensated gamma curves CURVE_RE1, CURVE_RE2, and CUREV_RE3 are merged into one white gamma curve CURVE_W1, a shape of the white gamma curve CUREV_W1 may be different from the shape of the compensated gamma curves CURVE_RE1, CURVE_RE2, and CURVE_RE3 and may represent a different gamma characteristic.

This is because when the pixels PX1, PX2, and PX3 simultaneously emit light, the influence of lateral leakage occurring in each of the pixels PX1, PX2, and PX3 decreases.

The second data compensator 440 (see FIG. 5) may perform second compensation on the white gamma curve CURVE_W1 to readjust the white gamma curve CURVE_W1 to a corrected/adjusted white gamma curve CURVE_W2. The corrected white gamma curve CURVE_W2 may match the reference gamma curve.

A compensation filter using the three colors as a reference may be applied to each channel of the image data corresponding to red, green, and blue to compensate for the lateral leakage.

When such a compensation filter is applied, a compensation characteristic for a mixed color (produced by mixed light of two colors among the three colors) is not sufficient. For example, when low gray level and/or low luminance yellow light is emitted by mixing red light and green light, low luminance (with reference to the input gray level) may be displayed due to the lateral leakage and insufficient compensation characteristic, or a low gray level color characteristic may deteriorate.

The display device 1000 and/or the second data compensator 440 of the controller 400 may apply a compensation filter suitable for mixed colors of red, green, and blue.

Figures 9, 10:
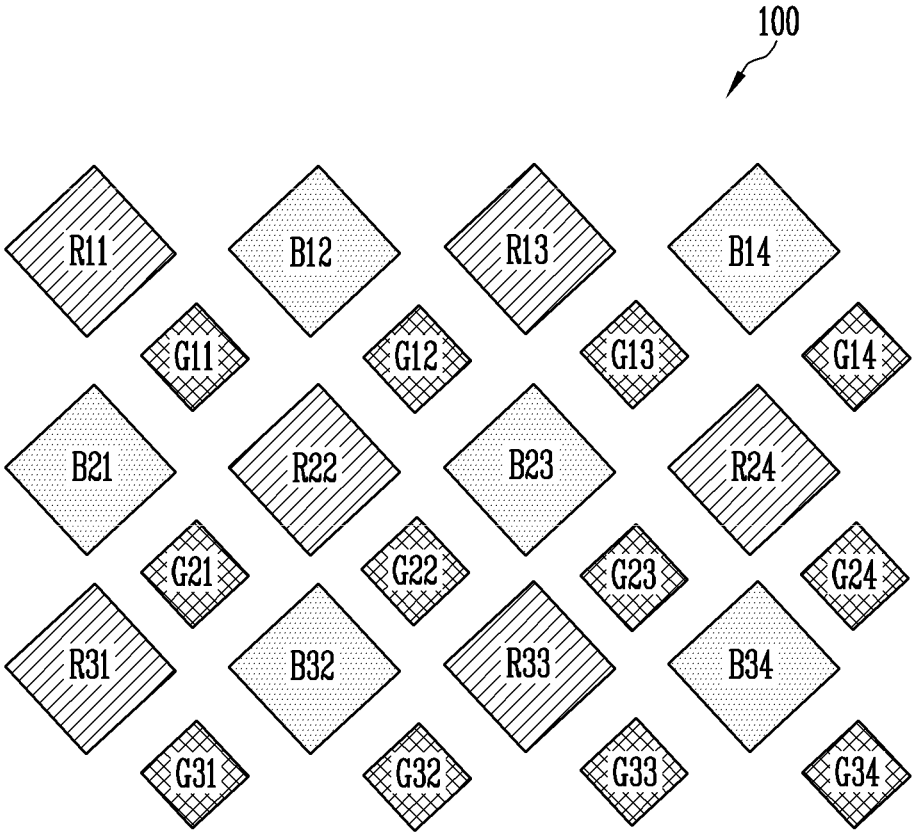
FIG. 9 illustrates a compensation filter used in a second data compensator included in the controller of FIG. 5 according to embodiments.
FIG. 10 illustrates a display area included in the display device of FIG. 1 according to embodiments.

FIG. 9 illustrates a compensation filter used in the second data compensator 440 included in the controller 400 illustrated in FIG. 5 according to embodiments.

Referring to FIG. 5 and FIG. 9, the second data compensator 440 may apply a compensation/adjustment filter FT to the image data (input gray level GRAY_IN or remapped gray level GRAY_RE) of the target pixel to calculate the compensated/adjusted gray level GRAY_C.

The compensation filter FT may have a structure of 1 row×5 columns, and may include weights a1, a2, a3, and a4 and a reference weight a0. The reference weight a0 is a coefficient applied to the remapped gray level GRAY_RE corresponding to the target pixel and may be, for example, 0.

Each of the weights a1, a2, a3, and a4 may be greater than or equal to 0 and may be less than 1. For example, each of the weights a1, a2, a3, and a4 may be a constant in a range of 0.01 to 0.2.

Each of the weights a1 to a4 may correspond to one of the relevant pixels around the target pixel. When the compensation filter FT includes 1 row×5 columns, the relevant pixels are the two left pixels and two right pixels of the target pixel in the same pixel row/set as the target pixel, and each of the weights a1 to a4 may correspond to one of the relevant pixels.

The further a pixel is from the target pixel, the smaller the effect of lateral leakage on the target pixel may be. Thus, the weight may be smaller as a relevant pixel is farther from the target pixel. The first weight a1 may be smaller than the second weight a2, and the fourth weight a4 may be smaller than the third weight a3.

The compensation filter FT may have a structure of 3 rows×3 columns.

FIG. 10 illustrates a display area included in the display device of FIG. 1 according to embodiments.

Referring to FIG. 10, the pixels included in the display area 100 may be arranged in an RGBG structure, for example, a PENTILE™ structure.

The pixels may be disposed so that a red pixel (e.g., R11), a green pixel (e.g., G11), a blue pixel (e.g., B12), and a green pixel (e.g., G12) are repeatedly arranged in a first pixel row/set (including two horizontal lines of pixels). The pixels may be disposed so that a blue pixel (e.g., B21), a green pixel (e.g., G21), a red pixel (e.g., R22), and a green pixel (e.g., G22) are repeatedly arranged in a second pixel row/set (including two horizontal lines of pixels).

Each of odd numbered pixel rows/sets includes pixels arranged in a manner substantially equivalent to the pixel arrangement structure of the first pixel row/set, and each of even numbered pixel rows/sets includes pixels arranged in a manner substantially equivalent to the pixel arrangement structure of the second pixel row/set.

Figure 11:
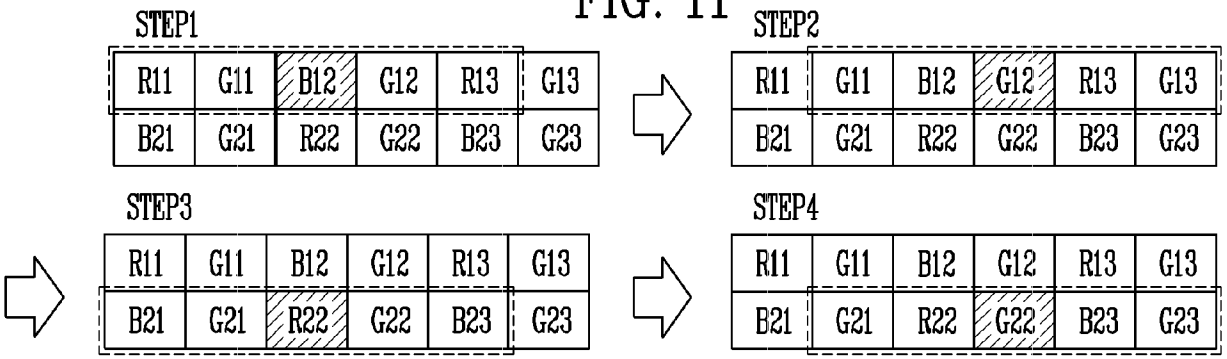
FIG. 11 illustrates that the compensation filter of FIG. 9 is applied to the display area of FIG. 10 according to embodiments.

FIG. 11 illustrates that the compensation filter of FIG. 9 is applied to the display area of FIG. 10 according to embodiments.

Referring to FIG. 5, FIG. 9, FIG. 10, and FIG. 11, the second data compensator 440 may sequentially change the target pixel (indicated by a hatched portion in FIG. 11), and the compensation filter FT may be sequentially applied to the image data of each of the changed target pixels.

The second data compensator 440 may (continuously) calculate the compensated gray level GRAY_C while moving the compensation filter FT by a pixel unit.

In a first step (STEP1), the second data compensator 440 may select the blue pixel B12 as the target pixel to apply the compensation filter FT. The second data compensator 440 may calculate the compensation/adjustment value or compensated/adjusted gray level GRAY_C corresponding to the blue pixel B12 based on gray levels and weights (a1 to a4) corresponding to the red pixel R11, the green pixel G11, the blue pixel B12, the green pixel G12, and a red pixel R13 corresponding to the compensation filter (FT). The red pixel R11, the green pixel G11, the green pixel G12, and the red pixel R13 may be relevant pixels when the blue pixel B12 is the target pixel.

In a second step (STEP2), the second data compensator 440 may select the green pixel G12 as the target pixel to apply the compensation filter FT. Accordingly, the compensation value or the compensated gray level GRAY_C corresponding to the green pixel G12 may be calculated.

When the calculation of the compensation value or the second compensated gray level GRAY_C for one pixel row/set is completed, the second data compensator 440 may sequentially apply the compensation filter FT to pixels of a next row/set.

In a third step (STEP3), the second data compensator 440 may select the red pixel R22 as the target pixel to apply the compensation filter FT. Accordingly, the compensation value or the compensated gray level GRAY_C corresponding to the red pixel R22 may be calculated.

Subsequently, in a fourth step (STEP4), the second data compensator 440 select the green pixel G22 as the target pixel to apply the compensation filter FT. The second data compensator 440 may repeatedly calculate the weights and the compensation values (or compensated gray levels GRAY_C) while moving the compensation filter FT by a pixel unit in a row direction (or horizontal direction).

Figure 12:
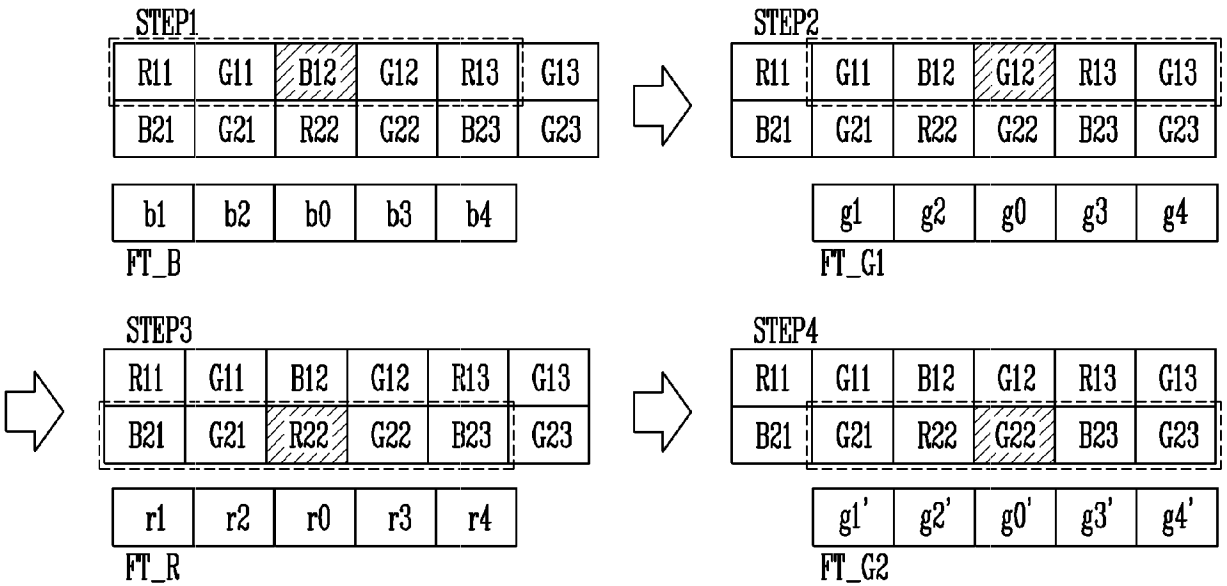
FIG. 12 illustrates that compensation filters are applied to the display area of FIG. 10 according to embodiments.

FIG. 12 illustrates that compensation filters are applied to the display area of FIG. 10 according to embodiments.

Referring to FIG. 9, FIG. 10, and FIG. 12, in the steps STEP1 to STEP4, the second data compensator 440 may selectively apply a blue filter FT_B, a first green filter FTG_1, a red filter (FT_R), and a second green filter FT_G2 for four different target pixels, respectively.

As shown in FIG. 12, in the first step (STEP1), the second data compensator 440 may apply the blue filter FT_B when the blue pixel B12 is the target pixel.

The blue filter FT_B may include a reference blue weight b0 and blue weights b1, b2, b3, and b4. The red filter FT_R may include a reference red weight r0 and red weights r1, r2, r3, and r4. The first green filter FTG_1 may include a first reference green weight g0 and first green weights g1, g2, g3, and g4. The second green filter FT_G2 may include a second reference green weight g0' and second green weights g1', g2', g3' and g4'.

Figure 13:
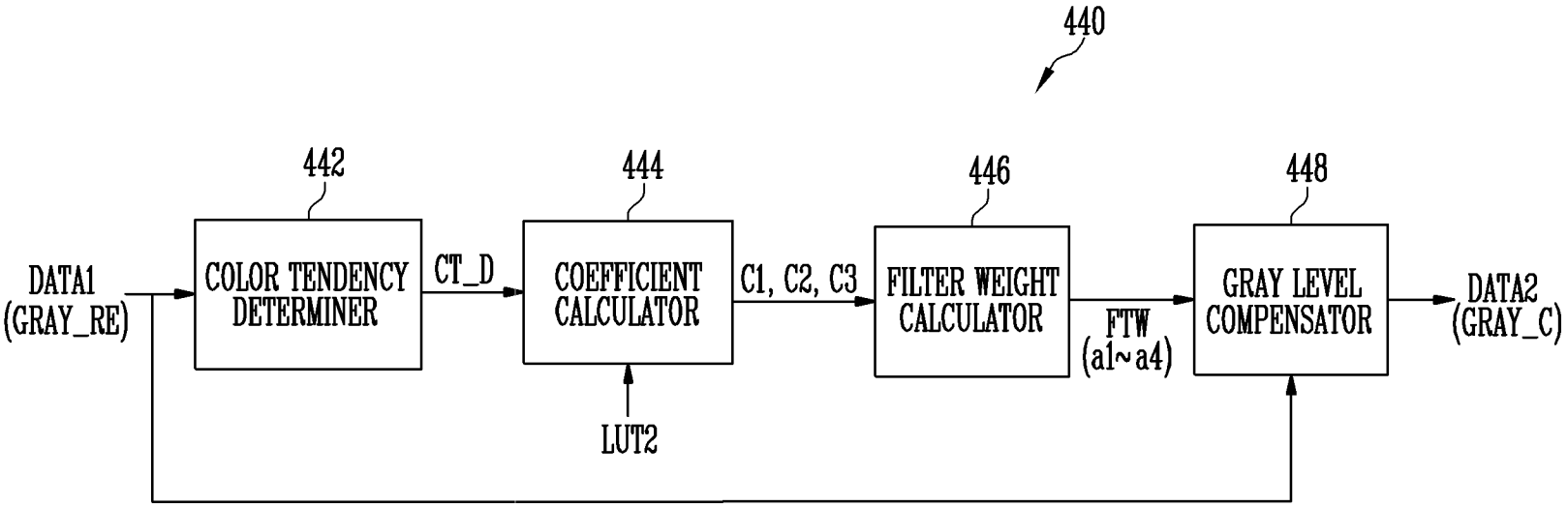
FIG. 13 illustrates a block diagram of a second data compensator included in the controller of FIG. 5 according to embodiments.

FIG. 13 illustrates a block diagram of the second data compensator/adjuster 440 included in the controller 400 illustrated in FIG. 5 according to embodiments. FIG. 14 illustrates a lookup table used in the second data compensator 440 illustrated in FIG. 13 according to embodiments. FIG. 15A to FIG. 15F are drawings for explaining calculations of weights using the lookup table of FIG. 14 according to embodiments.

Referring to FIG. 9 to FIG. 15F, the second data compensator 440 may include a color tendency determiner 442, a coefficient calculator 444, a filter weight calculator 446, and a gray level compensator/adjuster 448.

The first color, the second color, and the third color may be red, green, and blue, respectively. The first mixed color, the second mixed color, the third mixed color, and the fourth mixed colors may be yellow, magenta, cyan, and white, respectively.

The color tendency determiner 442 may determine a color tendency CT_D by comparing gray levels for colors of image data of pixels T_PX, PX1, PX2, PX3, and PX4 corresponding to the weights and positions specified in the compensation filter FT. The compensation filter FT may have a structure of 1 row×5 columns.

The color tendency determiner 442 may calculate an average of the red gray levels, an average of the green gray levels, and an average of the blue gray levels corresponding to the compensation filter FT.

Referring to FIG. 13, the color tendency determiner 442 may calculate averages of gray levels of each color from the first data DATA1 on which gray level remapping is performed. The color tendency determiner 442 may calculate the averages of the gray levels of each color using the input image data RGB.

The color tendency determiner 442 may compare the average of the red gray levels, the average of the green gray levels, and the average of the blue gray levels. Accordingly, the color of light mainly affecting the target pixel T_PX may be predicted.

The gray level relationship between these three colors may be one of six conditions shown in Table 1 below.

TABLE 1

| Condition | relationship |
|---|---|
| CONDITION1 | DI(R) ≥ DI(G) ≥ DI(B) |
| CONDITION2 | DI(R) ≥ DI(B) ≥ DI(G) |
| CONDITION3 | DI(B) ≥ DI(R) ≥ DI(G) |
| CONDITION4 | DI(G) ≥ DI(R) ≥ DI(B) |
| CONDITION5 | DI(G) ≥ DI(B) ≥ DI(R) |
| CONDITION6 | DI(B) ≥ DI(G) ≥ DI(R) |

An equal relationship may be established under all conditions. That is, when predetermined gray levels are the same, any condition may be applied. In the first condition CONDITION1, a red gray level DI(R) is greater than or equal to a green gray level DI(G), and the green gray level DI(G) is greater than or equal to a blue gray level DI(B). In the sixth condition CONDITION6, the blue gray level DI(B) is greater than or equal to the green gray level DI(G), and the green gray level DI(G) is greater than or equal to the red gray level DI(R).

The color tendency determiner 442 may provide the color tendency CT_D corresponding to one of the first to sixth conditions (CONDITION1 to CONDITION6) to the coefficient calculator 444.

The coefficient calculator 444 may calculate a first coefficient C1, a second coefficient C2, and a third coefficient C3 corresponding to red, green, and blue based on the color tendency CT_D and differences between reference coefficients R_FACT, G_FACT, B_FACT, C_FACT, M_FACT, Y_FACT, and W FACT. The reference coefficients R_FACT, G_FACT, B_FACT, C_FACT, M_FACT, Y_FACT, and W FACT may be values corresponding to red, green, blue, cyan, magenta, yellow, and white.

The coefficient calculator 444 may extract three-dimensional coordinate values of the reference coefficients R_FACT, G_FACT, B_FACT, C_FACT, M_FACT, Y_FACT, and W FACT corresponding to the color tendency CT_D from the second lookup table LUT2.

Figure 15A:
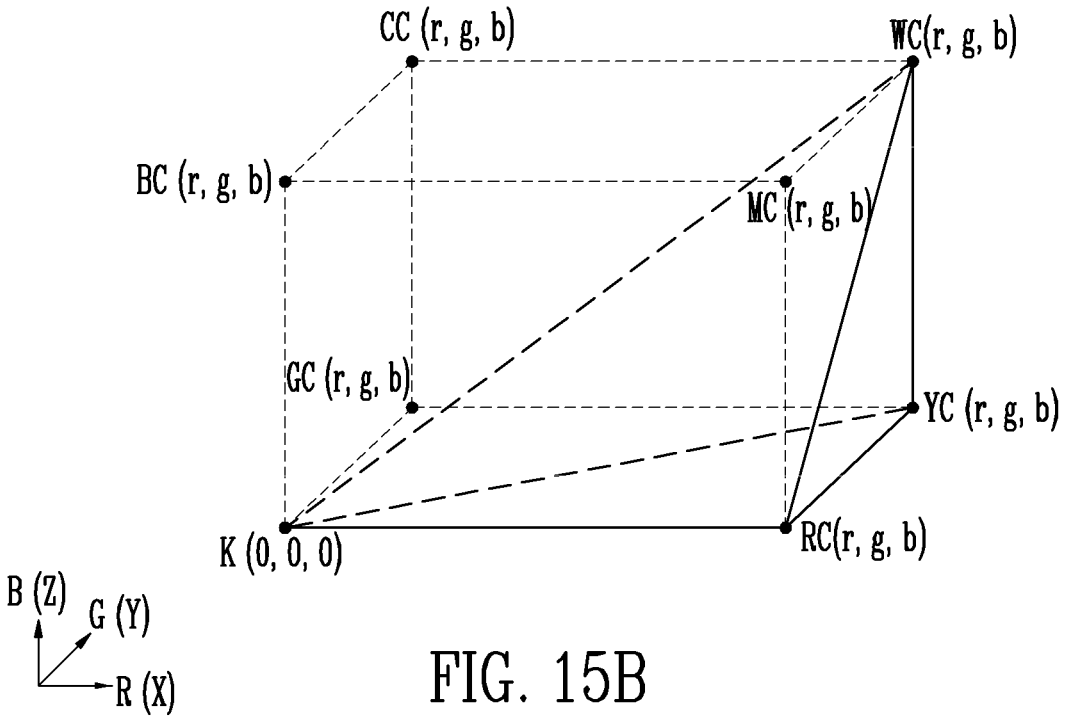
FIG. 15A, FIG. 15B, FIG. 15C, FIG. 15D, FIG. 15E, and FIG. 15F are drawings for explaining calculations of weights using the lookup table of FIG. 14 according to embodiments.
Figure 15B:
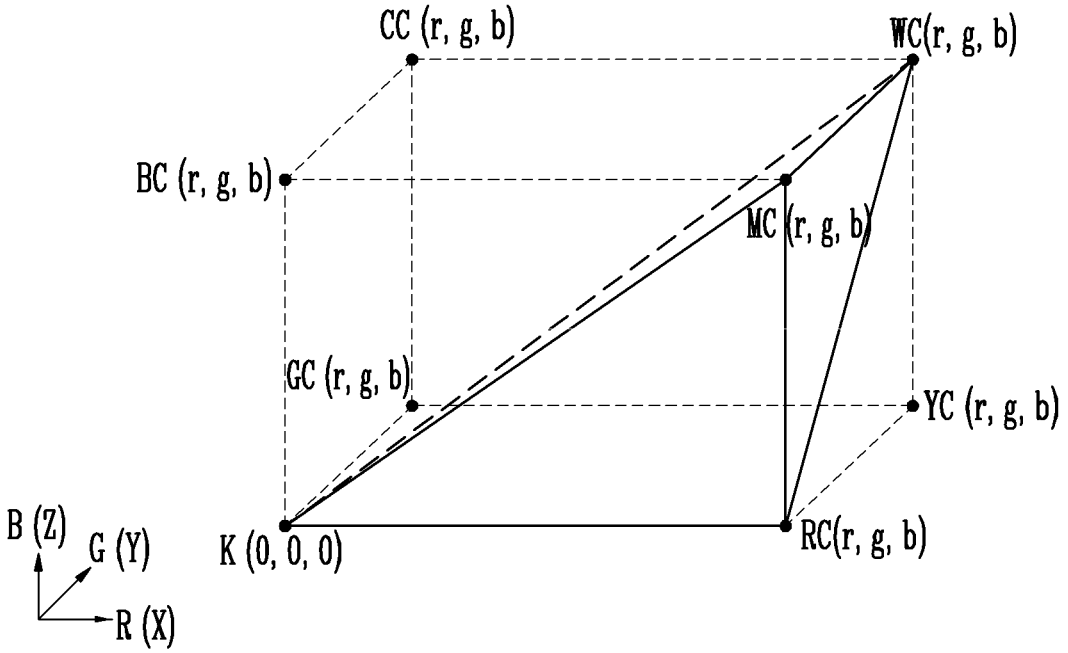
Figure 15C:
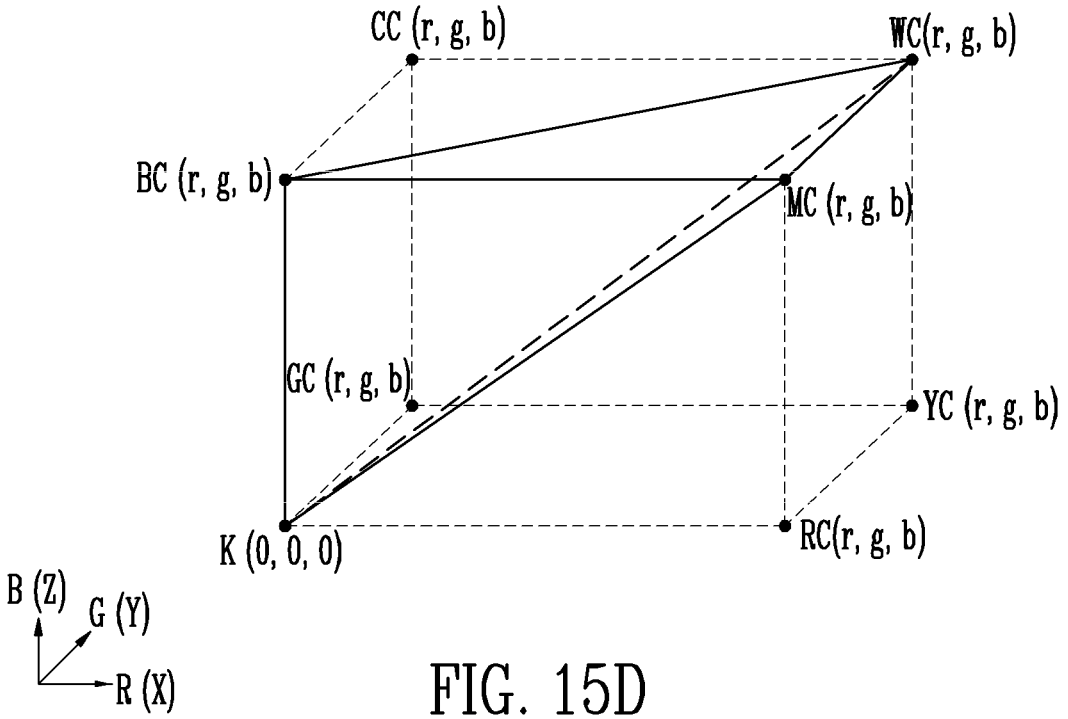
Figure 15D:
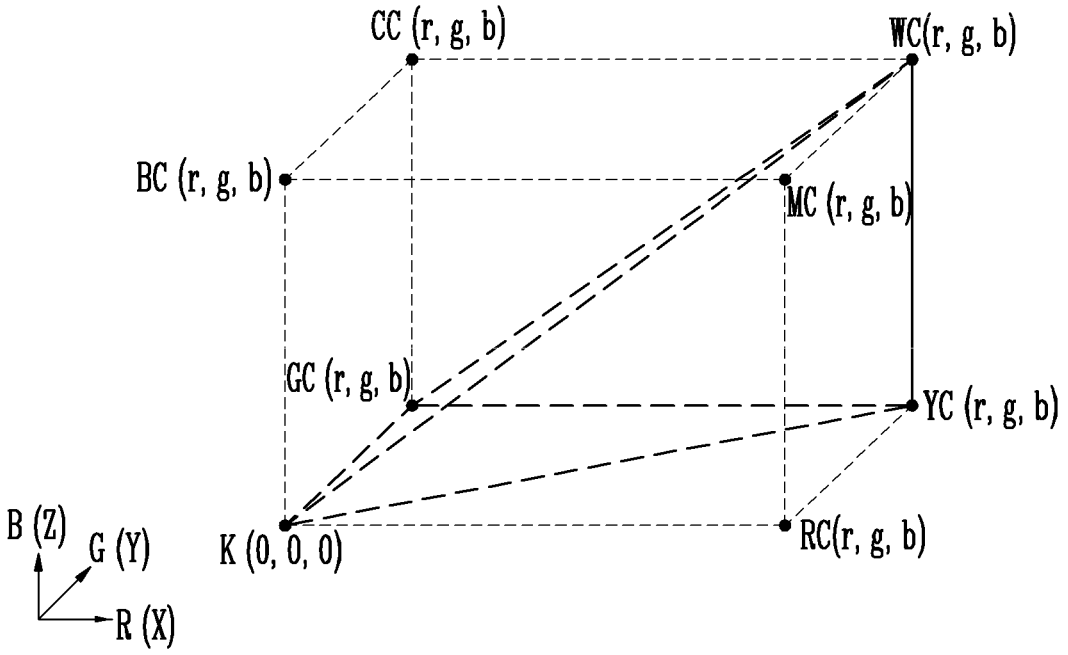
Figure 15E:
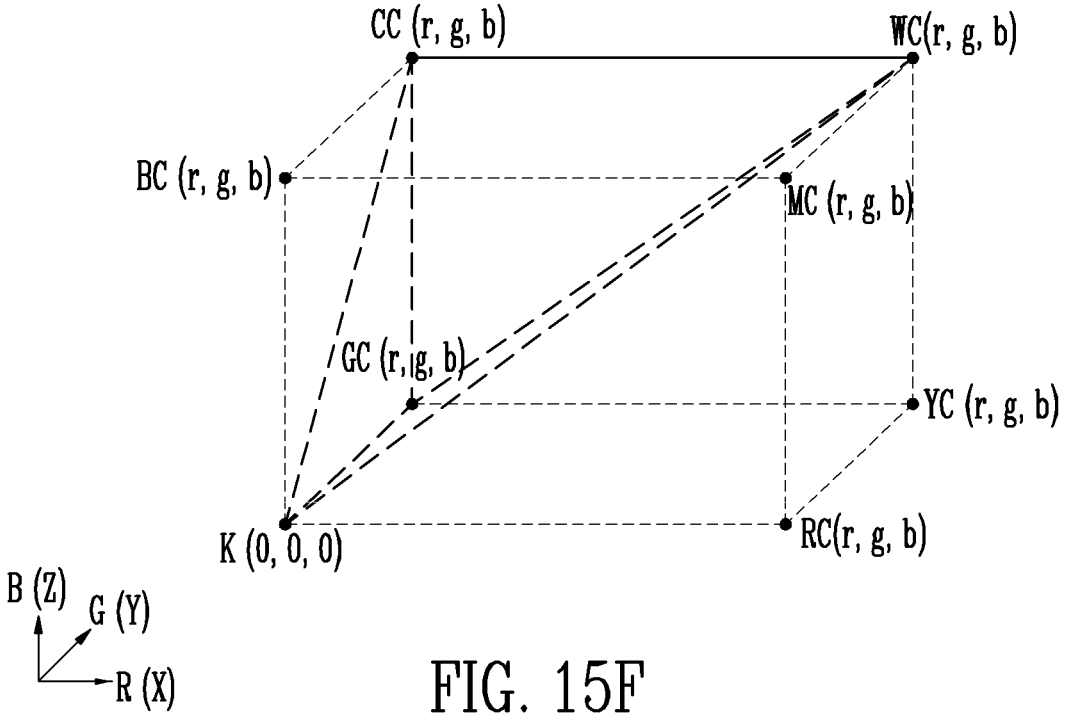
Figure 15F:
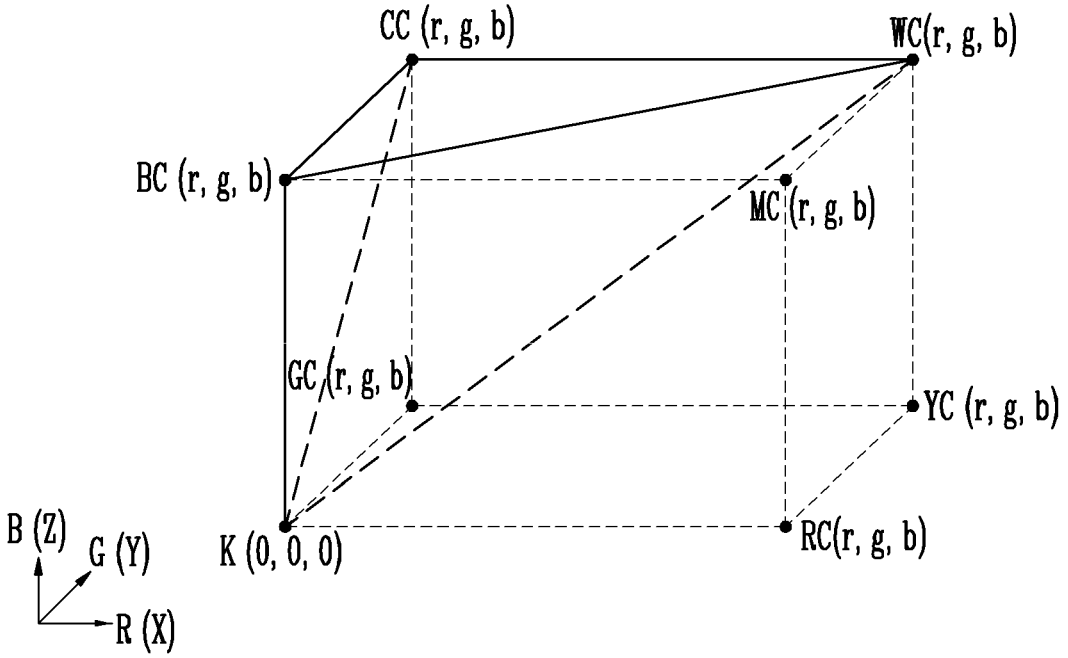

Referring to FIG. 14 to FIG. 15F, the second lookup table LUT2 may have a three-dimensional format. A hexahedron shown in each of FIG. 15A to 15F may be derived from the reference coefficients of the second lookup table LUT2. With K coordinate K(0, 0, 0) being an origin, a red coordinate value RC(r, g, b), a green coordinate value GC(r, g, b), a blue coordinate value BC(r, g, b), a yellow coordinate value YC(r, g, b), a magenta coordinate value MC(r, g, b), a cyan coordinate value CC(r, g, b), and a white coordinate values WC(r, g, b) may be determined through the second lookup table LUT2.

In each of FIG. 15A to 15F, an x-axis X may be a red axis R, a y-axis may be a green axis G, and a z-axis may be a blue axis B.

As shown in FIG. 14, the second lookup table LUT2 may include a first table including values of the reference coefficients (R_FACT, G_FACT, B_FACT, C_FACT, M_FACT, Y_FACT, and W FACT) corresponding to the x coordinate (that is, the red axis R), a second table including values of the reference coefficients (R_FACT, G_FACT, B_FACT, C_FACT, M_FACT, Y_FACT, and W FACT) corresponding to the y-coordinate (that is, the green axis G), and a third table including values of the reference coefficients (R_FACT, G_FACT, B_FACT, C_FACT, M_FACT, Y_FACT, and W FACT) corresponding to the z coordinate (that is, the blue axis B).

Each of the first to third tables, corresponding to the compensation filter FT, may include values of the reference coefficients (R_FACT, G_FACT, B_FACT, C_FACT, M_FACT, Y_FACT, and W FACT) that correspond to the relevant pixels (PX1, PX2, PX3, and PX4) and the target pixel T_PX.

The values of the reference coefficients (R_FACT, G_FACT, B_FACT, C_FACT, M_FACT, Y_FACT, and W FACT) may be experimentally determined through tests to check mutual influences and lateral leakage during light emission.

The red coordinate value RC(r, g, b), the green coordinate value GC(r, g, b), the blue coordinate value BC(r, g, b), the yellow coordinate value YC(r, g, b), the magenta coordinate value MC(r, g, b), the cyan coordinate value CC(r, g, b), and the white coordinate value WC(r, g, b) corresponding to the color tendency CT_D for each of the relevant pixels (PX1, PX2, PX3, and PX4) and target pixels T_PX may be determined through the second lookup table LUT2.

For a target pixel T_PX, coordinate values of a hexahedron for calculating coefficients (C1, C2, and C3) may be determined as follows.

The red coordinate value RC(r, g, b) may be RC(RR0, 0, 0), the green coordinate value GC(r, g, b) may be CG(0, GG0, 0), and the blue coordinate value BC(r, g, b) may be BC(0, 0, BB0). The yellow coordinate value YC(r, g, b) may be YC(RY0, GY0, 0), the magenta coordinate value MC(r, g, b) may be MC(RM0, 0, BM0), and the cyan coordinate value CC(r, g, b) may be CC(0, CG0, BC0). The white coordinate values WC(r, g, b) may be WC(RW0, GW0, BW0).

Analogously, the reference coefficients for the relevant pixels PX1 to PX4 may be extracted in a hexahedron format.

In FIG. 15A to FIG. 15F, a shape formed by the coordinates according to the reference coefficients (R_FACT, G_FACT, B_FACT, C_FACT, M_FACT, Y_FACT, and W FACT) may be a rectangular parallelepiped. The hexahedral shape may depend on the reference coefficients (R_FACT, G_FACT, B_FACT, C_FACT, M_FACT, Y_FACT, and W FACT).

The coefficient calculator 444 may calculate the coefficients C1, C2, and C3 corresponding to a condition of one of FIG. 15A to FIG. 15F using the second lookup table LUT2 and the color tendency CT_D. Referring to Table 1, the color tendency determiner 442 may select the color tendency CT_D corresponding to one of the six conditions CONDITION1 to CONDITION6.

The coefficient calculator 444 may extract the coordinate values corresponding to the color tendency CT_D, and may calculate a length/value in the x-axis X direction, a length/value in the y-axis Y direction, and a length/value in the z-axis Z direction from values to be extracted. The length in the x-axis X direction, the length in the y-axis Y direction, and the length in the z-axis Z direction may be determined as the first coefficient C1, the second coefficient C2, and the third coefficient C3, respectively.

The first coefficient C1, the second coefficient C2, and the third coefficient C3 may be calculated based on colors with high gray levels, that is, the reference coefficients of colors that have a major influence on the viewed color. The first coefficient C1, the second coefficient C2, and the third coefficient C3 for each of the six conditions CONDITION1 to CONDITION6 may be calculated as shown in Table 2 below.

TABLE 2

| Condition | relationship | C1 | C2 | C3 |
|---|---|---|---|---|
| CONDITION1 | DI(R) ≥ DI(G) ≥ DI(B) | \|RC−K\| | \|YC−RC\| | \|WC−YC\| |
| CONDITION2 | DI(R) ≥ DI(B) ≥ DI(G) | \|RC−K\| | \|WC−MC\| | \|MC−RC\| |
| CONDITION3 | DI(B) ≥ DI(R) ≥ DI(G) | \|MC−BC\| | \|WC−MC\| | \|BC−K\| |
| CONDITION4 | DI(G) ≥ DI(R) ≥ DI(B) | \|YC−GC\| | \|GC−K\| | \|WC−YC\| |
| CONDITION5 | DI(G) ≥ DI(B) ≥ DI(R) | \|WC−CC\| | \|GC−K\| | \|CC−GC\| |
| CONDITION6 | DI(B) ≥ DI(G) ≥ DI(R) | \|WC−CC\| | \|CC−BC\| | \|BC−K\| |

For example, in the first condition (CONDITION1), a red color and a yellow color (in which a red color and a green color are mixed) may mainly affect lateral leakage. Accordingly, the color tendency CT_D in the first condition (CONDITION1) may be defined as (and/or correspond to) a tetrahedron shown in FIG. 15A. The first coefficient C1 is a length in the x-axis X direction calculated from the tetrahedron of FIG. 15A, and may be determined as a distance (|RC−K|) between the red coordinate value RC(r, g, b) and the origin (K(0, 0, 0).

Similarly, the second coefficient C2 is a length in the y-axis Y direction calculated from the tetrahedron of FIG. 15A, and may be determined as a distance (|YC−RC|) between the yellow coordinate value YC(r, g, b) and the red coordinate value RC(r, g, b). The third coefficient C3 is a length in the z-axis Z direction calculated from the tetrahedron of FIG. 15A, and may be determined as a distance (|WC−YC|) between the white coordinate value WC(r, g, b) and the yellow coordinate value YC(r, g, b).

The reference coefficients of the target pixel T_PX, the first relevant pixel PX1, the second relevant pixel PX2, the third relevant pixel PX3, and the fourth relevant pixel PX4 may be independent of each other. Accordingly, the first to third coefficients (C1 to C3) may be separately calculated for each of the target pixel T_PX, the first relevant pixel PX1, the second relevant pixel PX2, the third relevant pixel PX3, and the fourth relevant pixel PX4.

In the second condition (CONDITION2), a red color and a magenta color (in which a red color and a blue color) are mixed may mainly affect lateral leakage. Accordingly, the color tendency CT_D in the second condition (CONDITION2) may be defined as (and/or correspond to) a tetrahedron shown in FIG. 15B. The first coefficient C1 may be determined as a distance (|RC−K|) between the red coordinate value RC(r, g, b) and the origin K(0, 0, 0). The second coefficient C2 may be determined as a distance (|WC−MC|) between the white coordinate value WC(r, g, b) and the magenta coordinate value MC(r, g, b). The third coefficient C3 may be determined as a distance (|MC−RC|) between the magenta coordinate value MC(r, g, b) and the red coordinate value RC(r, g, b).

In the third condition (CONDITION3), a blue color and a magenta color (in which a blue color and a red color) are mixed may mainly affect lateral leakage. Accordingly, the color tendency CT_D in the third condition (CONDITION3) may be defined as (and/or correspond to) a tetrahedron shown in FIG. 15C. The first coefficient C1 may be determined as a distance (|MC−BC|) between the magenta coordinate value MC(r, g, b) and the blue coordinate value BC(r, g, b). The second coefficient C2 may be determined as a distance (|WC−MC|) between the white coordinate value WC(r, g, b) and the magenta coordinate value MC(r, g, b). The third coefficient C3 may be determined as a distance (|BC−K|) between the blue coordinate value BC(r, g, b) and the origin K(0, 0, 0).

In the fourth condition (CONDITION4), a green color and a yellow color (in which a green color and a red color are mixed) may mainly affect lateral leakage. Accordingly, the color tendency CT_D in the fourth condition (CONDITION4) may be defined as (and/or correspond to) a tetrahedron shown in FIG. 15D. The first coefficient C1 may be determined as a distance (|YC−GC|) between the yellow coordinate value YC(r, g, b) and the green coordinate value GC(r, g, b). The second coefficient C2 may be determined as a distance (|GC−K|) between the green coordinate value GC(r, g, b) and the origin K(0, 0, 0). The third coefficient C3 may be determined as a distance (|WC−YC|) between the white coordinate value WC(r, g, b) and the yellow coordinate value YC(r, g, b).

In the fifth condition (CONDITION5), a green color and a cyan color (in which a green color and a blue color are mixed) may mainly affect lateral leakage. Accordingly, the color tendency CT_D in the fifth condition (CONDITION5) may be defined as (and/or correspond to) a tetrahedron shown in FIG. 15E. The first coefficient C1 may be determined as a distance (|WC−CC|) between the white coordinate value WC(r, g, b) and the cyan coordinate value CC(r, g, b). The second coefficient C2 may be determined as a distance (|GC−K|) between the green coordinate value GC(r, g, b) and the origin K(0, 0, 0). The third coefficient C3 may be determined as a distance (|CC−GC|) between the cyan coordinate value CC(r, g, b) and the green coordinate value GC(r, g, b).

In the sixth condition (CONDITION6), a blue color and a cyan color (in which a green color and a blue color) are mixed may mainly affect lateral leakage. Accordingly, the color tendency CT_D in the sixth condition (CONDITION6) may be defined as (and/or correspond to) a tetrahedron shown in FIG. 15F. The first coefficient C1 may be determined as a distance (|WC−CC|) between the white coordinate value WC(r, g, b) and the cyan coordinate value CC(r, g, b). The second coefficient C2 may be determined as a distance (|CC−BC|) between the cyan coordinate value CC(r, g, b) and the blue coordinate value BC(r, g, b). The third coefficient C3 may be determined as a distance (|BC−K|) between the blue coordinate value BC(r, g, b) and the origin K(0, 0, 0).

The filter weight calculator 446 applies the first to third coefficients (C1, C2, and C3) to ratios of gray levels for the first to three colors for the maximum gray level, thereby calculating weights FTW (that is, a1, a2, a3, and a4 shown in FIG. 9). A method of calculating the weights FWT may be expressed as Equation 2 below.

$$WV(n)=k+C1(n)*DI(R)/DMAX+C2(n)*DI(G)/DMAX+C3(n)*DI(B)/DMAX, \quad \text{[Equation 2]}$$

wherein n is a natural number less than or equal to 4.

WV(n) is a weight of an n-th relevant pixel, k is a constant used for additional compensation, C1(*n*) is a first coefficient C1 of the n-th relevant pixel, DI(R) is an average of red gray levels in the compensation filter FT, and DMAX is a maximum gray level set for a display device. C2(*n*) is a second coefficient C2 of the n-th relevant pixel, DI(G) is an average of the green gray levels in the compensation filter FT, C3(*n*) is a third coefficient C3 of the n-th relevant pixel, and DI(B) is an average of the blue-gray levels in the compensation filter FT.

A weight calculated using Equation 2 may be obtained by interpolating an actual gray level based on one of the tetrahedrons of FIG. 15A to FIG. 15F and the maximum gray level.

The average of respective gray levels may be calculated from first data DATA1. The average of respective gray levels may be calculated from the input image data RGB, for which gray level remapping is not performed.

The weights a1 to a4 of the compensation filter FT may be calculated according to Equation 2. The position and number of the relevant pixels and weights FTW may be configured according to the shape/structure and size of the compensation filter FT.

The gray level compensator/adjuster 448 may generate the compensated/adjusted gray level GRAY_C of the target pixel T_PX based on values obtained by applying the weights TFW to the rewrapped gray levels GRAY_RE of the pixels (The relevant pixels PX1 to PX4) of the compensation filter FT.

The gray level compensator 448 may calculate the compensated gray level GRAY_C of the target pixel T_PX through Equation 3 below.

$$CGV_TPX=GV_TPX-G1*G2*(a1*GV_PX1+a2*GV_PX2+a3*GV_PX3+a4*GV_PX4) \quad \text{[Equation 3]}$$

CGV_TPX is a compensation/adjustment value of the target pixel T_PX, GV_TPX is a gray level of the target pixel T_PX before compensation, G1 is a first gain, and G2 is a second gain; a1 to a4 are weights TFW, and GV_PX1 to GV_PX4 are remapped gray levels GRAY_RE of relevant pixels PX1 to PX4, respectively.

The first gain G1 may decrease as the remapped gray level GRAY_RE of the target pixel T_PX increases, and may be a value between 0 and 1. The second gain G2 may decrease as the dimming level of the display device 1000 increases, and may be a value between 0 and 1.

Referring to Table 1, Table 2, Equation 1, Equation 2, and Equation 3, the weights FTW and the compensated gray level GRAY_C of the target pixel T_PX may be adjusted according to the gray levels of the relevant pixels PX1 to PX4 and the gray level relationship (and/or gray level conditions) for each color of the gray levels corresponding to the compensation filter FT.

When at least one of the relevant pixels PX1 to PX4 emits light, a data signal corresponding to the input gray level of the first gray level and supplied to the target pixel T_PX may have a first voltage level. When none of the relevant pixels PX1 to PX4 emits light, a value of the data signal corresponding to the input gray level of the first gray level and supplied to the target pixel T_PX may have a second voltage level different from the first voltage level.

When the input image data RGB corresponding to the target pixel T_PX and the relevant pixels PX1 to PX4 has a gray level of 30 or less, according to gray levels corresponding to the relevant pixels PX1 to PX4, the value of the data signal supplied to the target pixel T_PX may be adjusted by an operation of the second data compensator 440.

The second data compensator 440 and/or the display device 1000 may adjust the gray level of the target pixel T_PX using the reference coefficients for other mixed colors and the gray level relationship (and/or gray level conditions) between the target pixel T_PX and the relevant pixels PX1 to PX4 for each color in addition to the gray levels of red, green, and blue. Accordingly, when mixed color light is emitted in a low gray level and/or low luminance condition, luminance degradation and mixed color characteristic degradation due to lateral leakage may be mitigated.

Figure 16:
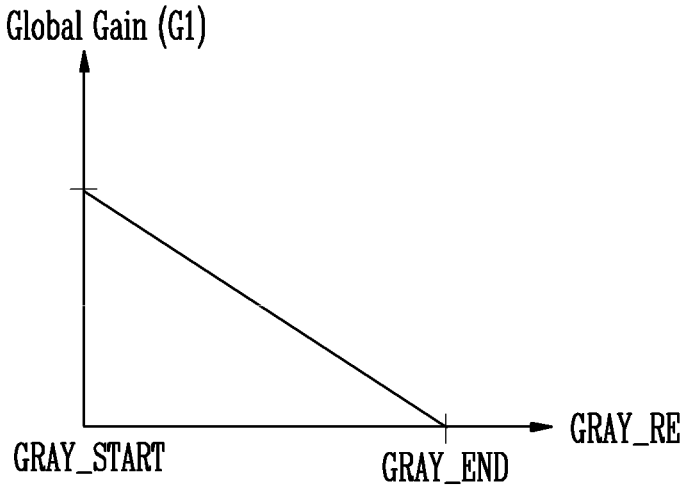
FIG. 16 illustrates a first gain used in the controller of FIG. 5 according to embodiments.
Figure 17:
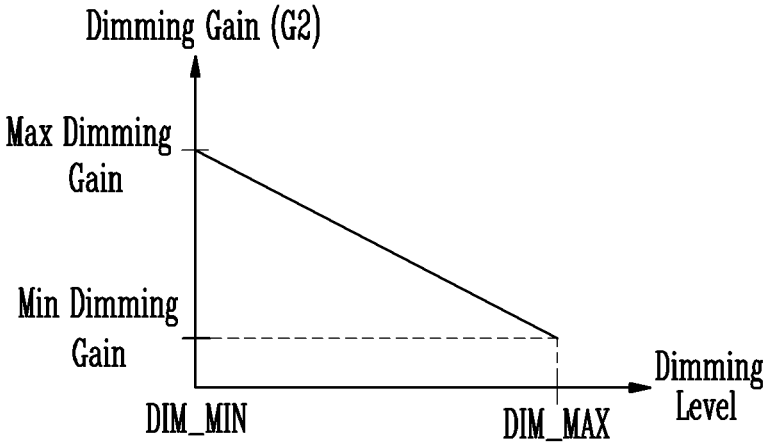
FIG. 17 illustrates a second gain used in the controller of FIG. 5 according to embodiments.

FIG. 16 illustrates a first gain used in the controller of FIG. 5 according to embodiments. FIG. 17 illustrates a second gain used in the controller of FIG. 5 according to embodiments.

Referring to FIG. 5, FIG. 13, FIG. 16, FIG. 17, and Equation 3, the first gain G1 and the second gain G2 may be applied for calculating the compensated/adjusted gray level GRAY_C of the target pixel T_PX.

The first gain G1 (or global gain) may have a maximum value (for example, 1) when the remapped gray level GRAY_RE is the same as a start gray level GRAY_START of the second gray level range. The first gain G1 may have a minimum value (for example, 0) when the remapped gray level GRAY_RE is the same as an end gray level GRAY_END of the second gray level range.

For example, when the remapped gray level GRAY_RE is 14, the first gain G1 may have a value of 1, and when the remapped gray level GRAY_RE is 32, the first gain G1 may have a value of 0.

The first gain G1 linearly decreases as the remapped gray level GRAY_RE increases within the second gray level range, and when the remapped gray level GRAY_RE is greater than the end gray level GRAY_END of the second gray level range, it may have the minimum value, for example, the value of 0.

The second gain G2 (or dimming gain) may be set based on the dimming level of the display device 1000, may decrease as the dimming level increases, and may have a value between 0 and 1. The second gain G2 (or dimming gain) may have a maximum value (Max Dimming Gain) (for example, 1) at a minimum dimming level (DIM_MIN), and may have a minimum value (Min Dimming Gain) (for example, 0 or close to 0) at a maximum dimming level (DIM_MAX), and may linearly decrease as the dimming level increases.

For example, when the dimming level is 25%, the second gain G2 may have a value of 1, and when the dimming level is 100%, the second gain G2 may have a value of 0.1.

The compensation/adjustment value provided in Equation 3 may be inversely proportional to the gray level and the dimming level.

Figure 18:
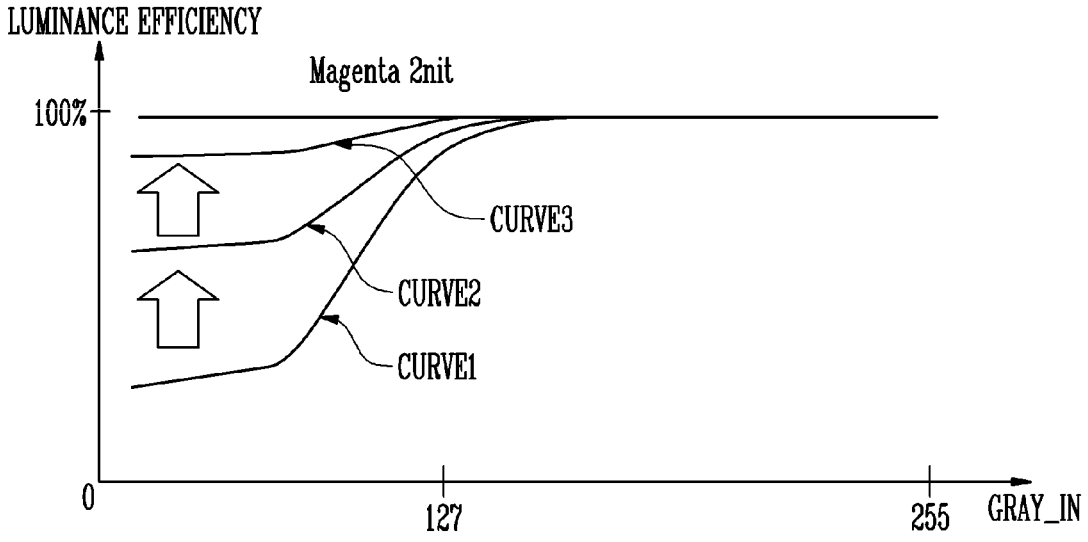
FIG. 18 illustrates a change in light emitting characteristics of pixels included in the display device of FIG. 1 according to embodiments.

FIG. 18 illustrates a change in light emitting characteristics of pixels included in the display device of FIG. 1 according to embodiments.

Referring to FIG. 5 to FIG. 18, the luminance efficiency at the time of emitting mixed color light in low luminance may vary according to the input gray level GRAY_IN.

The lower the input gray level GRAY_IN (due to the influence of lateral leakage), the lower the luminance efficiency may be. The luminance efficiency may be a ratio of the actually measured luminance to the expected luminance corresponding to the input gray level GRAY_IN. As the luminance efficiency approaches 100%, it meets the expected luminance. As the luminance efficiency decreases, the pixels may emit light with lower luminance than the expected luminance. FIG. 18 shows the luminance efficiency when magenta is viewed with a luminance of 2 nits.

A first efficiency curve CURVE1 shows an example in which no data compensation/adjustment is performed.

A second efficiency curve CURVE2 shows an example in which the compensation filter using only the three colors as a reference is applied to each channel of image data corresponding to red, green, and blue for lateral leakage compensation. Since the effect of the mixed colors is not considered, the improvement in the luminance efficiency in the low gray level area may not be sufficient.

A third efficiency curve CURVE3 is a luminance efficiency curve when sufficient data adjustment is applied to the image data of the target pixel. That is, the lateral leakage for not only red, green, and blue, but also for the mixed colors according to the relationship of gray levels of adjacent pixels may be incorporated for the gray level compensation/adjustment. Accordingly, when mixed color light is emitted in a low gray level and/or low luminance condition, luminance degradation and mixed color characteristic degradation due to lateral leakage may be mitigated.

FIG. 19 illustrates a lookup table used in the second data compensator of FIG. 5 according to embodiments.

A second lookup table LUT2" of FIG. 19 may be substantially the same as the second lookup table LUT2 described with reference to FIG. 14, except for values of some reference coefficients.

Referring to FIG. 19, the second lookup table LUT2' may include values of three-dimensional coordinates of reference coefficients (R_FACT, G_FACT, B_FACT, C_FACT, M_FACT, Y_FACT, and W FACT) with respect to 7 colors (red, green, blue, cyan, magenta, yellow, and white). The second lookup table LUT2' may include the reference coefficients (R_FACT, G_FACT, B_FACT, C_FACT, M_FACT, Y_FACT, and W FACT) with respect to the target pixel T_PX, the first relevant pixel PX1, the second relevant pixel PX2, the third relevant pixel PX3, and the fourth relevant pixel PX4, respectively.

The reference coefficients having a value of 0 in FIG. 14 may have a value other than 0 in FIG. 19. Accordingly, more accurate data compensation (gray level compensation) for lateral leakage may be realized.

FIG. 20 illustrates compensation filters applicable to the second data compensator of FIG. 5 according to embodiments.

Referring to FIG. 20, compensation filters FT2, FT3, and FT4 may have various forms and sizes according to settings.

The second compensation filter FT2 may have a structure of 1 row by 3 columns. Accordingly, compared with the compensation filter FT of FIG. 9, the second compensation filter FT2 may reduce or minimize a size of a line memory for storing gray levels of relevant pixels. The second compensation filter FT2 may correspond to two relevant pixels and may include two calculated weights a1 and a2. A method of calculating the gray level compensated using the second compensation filter FT2 may be similar to that described above.

The third compensation filter FT3 may have a structure of 3 rows by 3 columns. The gray level of the target pixel may be adjusted by considering lateral leakage due to light emission of pixels in the same pixel row as the target pixel and pixels in adjacent pixel rows. The third compensation filter FT3 may include weights a1, a2, a3, a4, a5, a6, a7, and a8 for the relevant pixels (or adjacent pixels).

For even more advanced lateral leakage compensation, the fourth compensation filter FT4 may have a structure of 3 rows by 5 columns. The fourth compensation filter FT4 may include weights a1, a2, a3, a4, a5, a6, a7, a8, a9, a10, a11, a12, a13, and a14.

The size and structure of the compensation filter may be configured according to embodiments.

Figure 21:
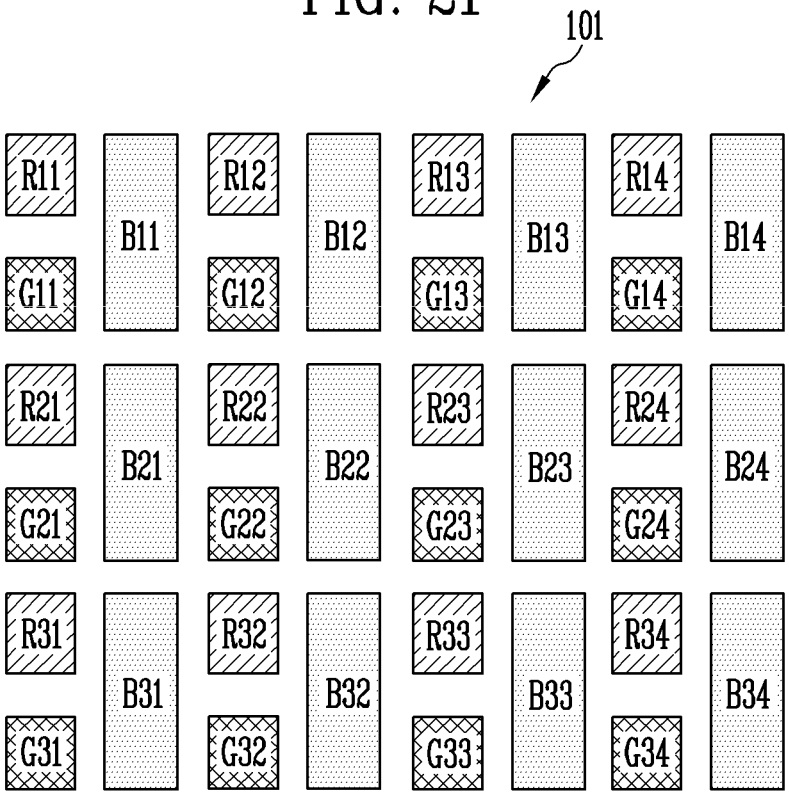
FIG. 21 illustrates a display area included in the display device of FIG. 1 according to embodiments.
Figure 22:
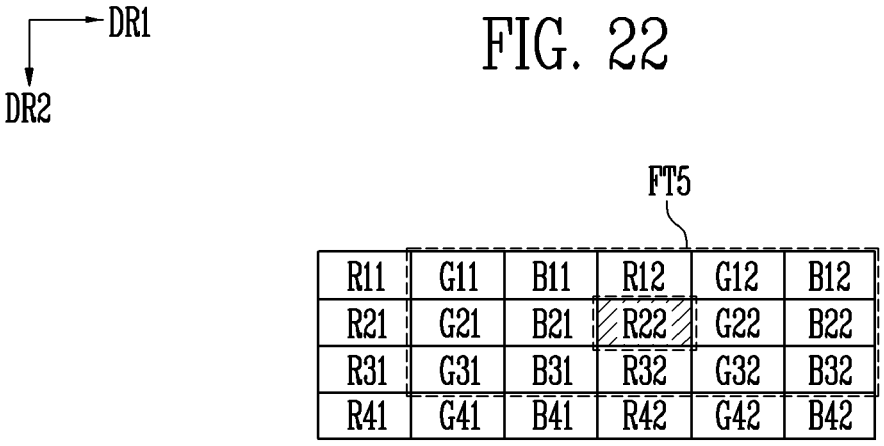
FIG. 22 illustrates a compensation filter applied to the display area of FIG. 21 according to embodiments.

FIG. 21 illustrates a display area included in the display device of FIG. 1 according to embodiments. FIG. 22 illustrates a compensation filter applied to the display area of FIG. 21 according to embodiments.

Referring to FIG. 1, FIG. 21, and FIG. 22, a display area 101 may have a pixel arrangement in which red pixels and green pixels are alternately arranged in a red-green pixel column in second direction DR2, and blue pixels are disposed in a blue pixel column immediately neighboring the red-green pixel column.

In the display area 101, the light emitting area of each blue pixel may be larger than the light emitting area of each red pixel and may be larger than the light emitting area of each green pixel.

Red pixels R11, R12, R13, and R14, green pixels G11, G12, G13, and G14, and blue pixels B11, B12, B13, and B14 may be included in the first row/set and may be controlled by the same scan line (for example, first scan line). Red pixels (R21, R22, R23, and R24, green pixels G21, G22, G23, and G24, and blue pixels B21, B22, B23, and B24 may be included in the second row/set and may be controlled by the second scan line.

FIG. 22 shows a compensation filter FT5 applied to the display area 101. The red pixel R22 may be a target pixel, and pixels neighboring the target pixel R22 may be relevant pixels.

The compensation filter FT5 may be shifted by a pixel unit, and the gray level of the corresponding target pixel may be adjusted.

Figure 23:
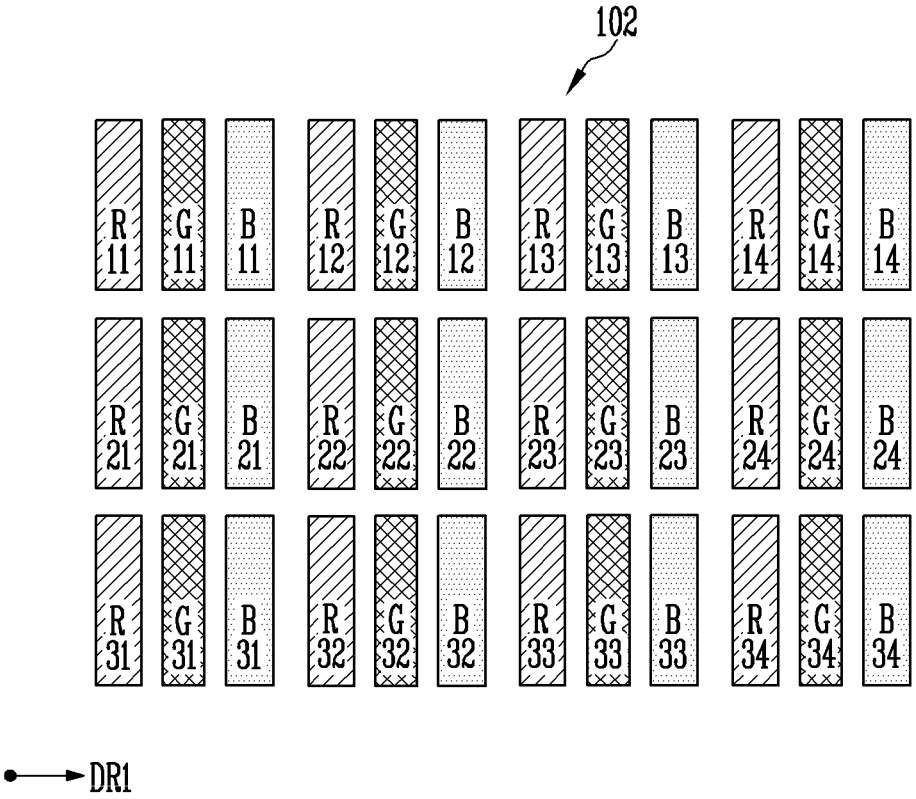
FIG. 23 illustrates a display area included in the display device of FIG. 1 according to embodiments.
Figure 24:
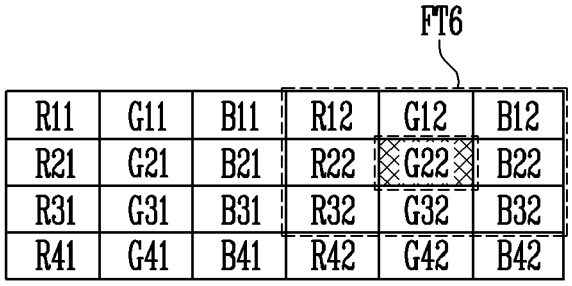
FIG. 24 illustrates a compensation filter applied to the display area of FIG. 23 according to embodiments.

FIG. 23 illustrates a display area included in the display device of FIG. 1 according to embodiments. FIG. 24 illustrates a compensation filter applied to the display area of FIG. 23 according to embodiments.

Referring to FIG. 1, FIG. 23, and FIG. 24, the display area 102 may have a pixel arrangement structure in which red pixels, green pixels, and blue pixels are arranged in a first direction DR1. Red pixels may be arranged in a first pixel column. Green pixels may be arranged in a second pixel column immediately neighboring the first pixel column. Blue pixels may be arranged in a third pixel column immediately neighboring the second pixel column.

Red pixels R11, R12, R13, and R14, green pixels G11, G12, G13, and G14, and blue pixels B11, B12, B13, and B14 may be included the first pixel row and may be controlled by the same scan line (for example, first scan line). Red pixels R21, R22, R23, and R24, green pixels G21, G22, G23, and G24, and blue pixels B21, B22, B23, and B24 may be included in the second row and may be controlled by the second scan line.

FIG. 24 shows a compensation filter FT6 applied to a display area 102. The green pixel G22 may be a target pixel, and pixels neighboring the target pixel G22 may be relevant pixels.

The compensation filter FT6 may be shifted by a pixel unit, and the gray level of the corresponding target pixel may be adjusted.

As can be appreciated from the above description, a display device according to embodiments may adjust a gray level of a target pixel using reference coefficients for predetermined mixed colors and gray level relationships between the target pixel and relevant pixels. Accordingly, when mixed color light is emitted in a low gray level and/or low luminance condition, luminance degradation and mixed color characteristic degradation due to lateral leakage may be mitigated.

While example embodiments have been described, practical embodiments are not limited to the example embodiments. Practical embodiments cover various modifications and equivalent arrangements within the scope of the appended claims.

What is claimed is:

1. A display device comprising:

pixels for displaying an image;

a controller, which receives image data, selects a target pixel among the pixels, and generates an adjusted gray level for the target pixel based on a gray level corresponding to the target pixel and gray levels corresponding to relevant pixels neighboring the target pixel;

a data line; and a data driver, which generates a data signal based on the adjusted gray level and supplies the data signal to the target pixel through the data line, wherein the target pixel, at least one of the relevant pixels, and at least one of the pixels of the display device respectively emit light of three colors different from each other, wherein four mixed colors are different from each other and are each a mixture of at least two of the three colors, and wherein the controller generates the adjusted gray level using reference coefficients for at least one of the three colors and for at least one of the four mixed colors.

2. The display device of claim 1, wherein the controller comprises:

a first data adjuster, which remaps gray levels in a first gray level range into first adjusted gray levels in a second gray level range; and a second data adjuster, which calculates adjustment coefficients based on the reference coefficients, and applies weights calculated based on the adjustment coefficients to the first adjusted gray levels to generate the adjusted gray level for the target pixel.

3. The display device of claim 2, wherein the controller selects the target pixel and the relevant pixels according to a structure of a predetermined adjustment filter.

4. The display device of claim 3, wherein the controller further comprises:

a memory storing a lookup table, which includes reference coefficients for seven colors for the target pixel and each of the relevant pixels, wherein the seven colors include the three colors and the four mixed colors.

5. The display device of claim 4, wherein an information set extracted from the lookup table is a three-dimensional coordinate consisting of three of the reference coefficients for the seven colors with the three colors corresponding to three coordinate axes, respectively.

6. The display device of claim 5, wherein the lookup table comprises a first table including a first subset of the reference coefficients for the seven colors corresponding to coordinates of a first axis, comprises a second table including a second subset of the reference coefficients for the seven colors corresponding to coordinates of a second axis, and comprises a third table including a third subset of the reference coefficients for the seven colors corresponding to coordinates of a third axis.

7. The display device of claim 6, wherein reference coefficients in each of the first subset of the reference coefficients for the seven colors, the second subset of the reference coefficients for the seven colors, the third subset of the reference coefficients for the seven colors depend on pixel positions specified in the predetermined adjustment filter.

8. The display device of claim 4, wherein the second data adjuster comprises:

a color tendency determiner, which determines a color tendency by comparing gray levels for the three colors according to image data for the target pixel and the relevant pixels;

a coefficient calculator, which calculates a first coefficient, a second coefficient, and a third coefficient respectively corresponding to the three colors based on the color tendency and coordinate values determined by differences between some of the reference coefficients for the seven colors;

a filter weight calculator, which calculates weights for the relevant pixels using the first coefficient, gray level values for the three colors, and a maximum gray level value for the display device; and a gray level adjuster, which generates the adjusted gray level for the target pixel by applying the weights to first adjusted gray levels of the target pixel and the relevant pixels.

9. The display device of claim 8, wherein the three colors include red, green, and blue.

10. The display device of claim 9, wherein the four mixed colors include yellow, magenta, cyan, and white.

11. The display device of claim 9, wherein the color tendency determiner determines the color tendency based on one of six conditions according to a relationship between a gray level of the red, a gray level of the green, and a gray level of the blue.

12. The display device of claim 11, wherein the coefficient calculator extracts three-dimensional coordinate values of reference coefficients corresponding to the color tendency from the lookup table, and wherein the three-dimensional coordinate values define a tetrahedron in a color space.

13. The display device of claim 12, wherein the first coefficient, the second coefficient, and the third coefficient are a length in a first axis direction, a length in a second axis direction, and a length in a third axis direction corresponding to three edges of the tetrahedron.

14. The display device of claim 1, wherein when at least one of the relevant pixels emits light, the data signal supplied to the target pixel has a first voltage level, and when the relevant pixels do not emit light, the data signal supplied to the target pixel has a second voltage level different from the first voltage level.

15. The display device of claim 14, wherein when the gray level corresponding to the target pixel and the gray levels corresponding to the relevant pixels are 30 or less according to the image data, the data signal supplied to the target pixel is adjusted according to the gray levels corresponding to the relevant pixels.

16. A method of driving a display device, the method comprising:

selecting a target pixel and relevant pixels according to an adjustment filter;

determining a color tendency by comparing gray levels according to image data for colors corresponding to the target pixel and the relevant pixels;

calculating a first coefficient, a second coefficient, and a third coefficient respectively corresponding to three colors of pixels of the display device based on reference coefficients and the color tendency;

calculating weights for the relevant pixels using the first coefficient, the second coefficient, the third coefficient, a gray level values for the three colors, and a maximum gray level value for the display device;

generating an adjusted gray level for the target pixel by applying the weights to the relevant pixels;

converting the adjusted gray level into an analog data signal; and supplying the analog data signal through a data line to the target pixel for the target pixel to emit light, wherein the reference coefficients are for at least one of the three colors and for at least one of four mixed colors, and wherein the four mixed colors are different from each other and are each a mixture of at least two of the three colors.

17. The method of claim 16, wherein at least one of the relevant pixels immediately neighbors the target pixel with no intervening pixel.

18. The method of claim 17, wherein the calculating of the first coefficient, the second coefficient, and the third coefficient comprises:

extracting three-dimensional coordinate values of reference coefficients corresponding to the color tendency from a lookup table, which includes reference coefficients for the three colors and the four mixed colors for the target pixel and each of the relevant pixels; and determining a length in a first axis direction, a length in a second axis direction, and a length in a third axis direction along three edges of a tetrahedron defined by the extracted three-dimensional coordinate values as the first coefficient, the second coefficient, and the third coefficient, respectively.

* * * * *